US007720199B2

(12) United States Patent
Inazuru

(10) Patent No.: US 7,720,199 B2
(45) Date of Patent: May 18, 2010

(54) X-RAY TUBE AND X-RAY SOURCE INCLUDING SAME

(75) Inventor: Tutomu Inazuru, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 177 days.

(21) Appl. No.: 12/089,154

(22) PCT Filed: Oct. 3, 2006

(86) PCT No.: PCT/JP2006/319777

§ 371 (c)(1),
(2), (4) Date: May 15, 2008

(87) PCT Pub. No.: WO2007/043395

PCT Pub. Date: Apr. 19, 2007

(65) Prior Publication Data

US 2009/0268873 A1 Oct. 29, 2009

(30) Foreign Application Priority Data

Oct. 7, 2005 (JP) ..... 2005-295730
Oct. 7, 2005 (JP) ..... 2005-295732

(51) Int. Cl.
*H01J 5/18* (2006.01)

(52) U.S. Cl. ..... 378/140; 378/123; 378/121; 378/119

(58) Field of Classification Search ..... 378/119, 378/121, 123, 140
See application file for complete search history.

(56) References Cited

U.S. PATENT DOCUMENTS

| | | | | |
|---|---|---|---|---|
| 5,077,771 | A | 12/1991 | Skillicorn et al. | 378/102 |
| 5,563,923 | A | 10/1996 | Okada et al. | 378/138 |
| 6,229,876 | B1 | 5/2001 | Enck et al. | 378/136 |
| 6,381,305 | B1 | 4/2002 | Okada et al. | 378/137 |
| 7,085,353 | B2 * | 8/2006 | Yoshiyama et al. | 378/123 |

FOREIGN PATENT DOCUMENTS

| | | |
|---|---|---|
| JP | 7-296751 | 11/1995 |
| JP | 2004-207053 | 7/2004 |

* cited by examiner

*Primary Examiner*—Courtney Thomas
(74) *Attorney, Agent, or Firm*—Drinker Biddle & Reath LLP

(57) ABSTRACT

The present invention relates to an X-ray tube, having a structure for effectively suppressing discharge at a tip of an anode, irradiated with electrons in order to generate X-rays, and an X-ray source including the X-ray tube. In the X-ray tube, electrons emitted from an electron gun are made to collide with an X-ray target, and X-rays generated at the X-ray target due to the collision are taken out to an exterior. The X-ray tube includes: a head, defining an internal space that houses a tip of an anode; an irradiation window, transmitting the generated X-rays to the exterior; an exhaust port, disposed at an inner wall surface of a casing and being for vacuum drawing of the internal space; and a shielding structure, hiding the exhaust port from the tip of the anode.

14 Claims, 20 Drawing Sheets

X-RAY TUBE AND X-RAY SOURCE INCLUDING SAME

TECHNICAL FIELD

The present invention relates to an X-ray tube taking out X-rays generated wherein toward an exterior, and an X-ray source in which the X-ray tube and a power supply unit are configured integrally.

BACKGROUND ART

X-rays are electromagnetic waves that are highly transmitted through objects and are frequently used for nondestructive, noncontact observation of internal structures of objects. As a conventional X-ray irradiation apparatus applicable to such fields, an X-ray tube, described in Patent Document 1 indicated below, is known. An X-ray generating unit of the X-ray tube described in Patent Document 1 has a tubular casing that houses a target, and an exhaust pipe, put in communication with an internal space, is mounted to the casing (see FIG. 4, etc., of Patent Document 1). In manufacturing the X-ray tube, vacuum is drawn from the internal space of the casing via the exhaust pipe. After vacuum drawing, the exhaust pipe is closed and the internal space that houses the target is put in a vacuum state (state of being depressurized to a predetermined degree of vacuum).

Patent Document 1: U.S. Pat. No. 6,229,876

DISCLOSURE OF THE INVENTION

Problems that the Invention is to Solve

The present inventors have examined the conventional X-ray tubes, and as a result, have discovered the following problems. That is, in the conventional X-ray tube, the exhaust port for drawing vacuum is formed in an inner wall surface of the casing onto which the exhaust pipe is mounted, and at an edge of the exhaust port, a corner portion with a sharp tip is present at a boundary with the casing inner wall. When a high potential difference is generated across the casing and an anode during driving of the X-ray tube, an electric field across the casing and the anode may become disrupted due to an influence of the corner portion. A possibility of discharge occurring across the casing and a tip of the anode thus increases due to the presence of the corner portion that is inevitably formed due to forming of the exhaust port. However, in the conventional X-ray tube, no measures are taken to suppress such discharge and there was a possibility of destabilization of the X-ray output due to such discharge.

The present invention has been developed to eliminate the problems described above. It is an object of the present invention to provide an X-ray tube having a structure for effectively suppressing discharge at a tip of an anode that is irradiated with electrons to generate X-rays, and to provide an X-ray source including the X-ray tube.

Means for Solving the Problems

An X-ray tube according to the present invention irradiates X-rays generated at an X-ray target to an exterior by making electrons emitted from an electron gun be incident on the X-ray target of an anode. The X-ray tube comprises a casing, an irradiation window (X-ray emission window) disposed on the casing; an exhaust port, and a shielding structure. The casing defines an internal space housing a tip of the anode that is irradiated with electrons. The irradiation window is disposed on the casing defining the internal space, in order to take out the X-rays generated at the X-ray target to the exterior of the casing. The exhaust port is prepared for vacuum drawing of the internal space and is disposed at an inner wall surface of the casing. In particular, the shielding structure is disposed in the internal space of the casing so as to hide the exhaust port from the tip of the anode.

Here, as a first aspect, the shielding structure preferably includes a shielding member comprised of a conductive material and having an inner side surface that faces the tip of the anode, and an outer side surface opposing the inner side surface.

In the X-ray tube having the above-described structure, the exhaust port is disposed at the inner wall surface of the casing. A corner portion with a sharp tip is thus formed as a boundary between an edge of the exhaust port and the inner wall surface of the casing. The present X-ray tube is thus provided with a structure, with which the exhaust port is hidden from the tip of the anode by the shielding member. Thus, in this X-ray tube, disruption of an electric field across the anode and the edge of the exhaust port during driving is alleviated and discharge at the tip of the anode is suppressed effectively.

In order to exhibit the above action effectively, the shielding member is preferably disposed between the tip of the anode and the exhaust port in a state of being separated by a predetermined distance from the inner wall surface at the exhaust port side of the casing. In addition, at least the inner side surface of the shielding member that faces the tip of the anode preferably has an area larger than an opening area of the exhaust port. In this configuration, the edge of the exhaust port (the corner portion with the sharp tip) can be covered reliably. Also, during manufacture of the X-ray tube, vacuuming of the internal space can be performed using a gap between the shielding member and the inner wall surface at the exhaust port side as a passage for air.

The shielding member may also be disposed in the internal space in a state of being separated by a predetermined distance from an inner wall surface at the irradiation window side of the casing. In this configuration, during manufacture of the X-ray tube, vacuuming of the internal space can be performed using a gap between the shielding member and the inner wall surface at the irradiation window side as a passage for air.

The shielding member may be provided with a plurality of through holes each communicating between the inner side surface facing the tip of the anode and the outer side surface opposing the inner side surface. In this case, at the tiem of vacuuming the internal space during manufacture of the X-ray tube, the through holes serve as passages for air from the internal space and vacuum drawing can thus be performed efficiently.

The shielding member may be a part of the casing that extends from an inner wall surface of the casing to the internal space. In this case, the inner side surface of the shielding member that opposes the tip of the anode is matched with the inner wall surface of the portion of the casing. In this configuration, the surface of the shielding member and the inner wall surface of the casing can be made smoothly continuous with respect to each other. Disruption of the electric field is thus alleviated and the discharge at the tip of the anode can be suppressed further.

The shielding member may have a plurality of through holes each putting the inner side surface and the outer side surface in communication, and be disposed so that the inner side surface facing the tip of the anode is matched with the inner wall surface of the casing. In this case, because the exhaust port is closed by the shielding member, the shielding member is required to have the plurality of through holes that serve as passages for air during vacuum drawing. In the X-ray tube, because the shielding member that closes the exhaust port is formed flush to the inner wall surface of the casing at which the exhaust port is formed, a corner portion with a sharp tip does not appear at the edge of the exhaust port and disruption of the electric field across the tip of the anode and the exhaust port is alleviated. As a result, the discharge at the tip of the anode is suppressed effectively. Because the plurality of communicating holes formed in the shielding member serve as passages for air, vacuum drawing of the internal space during manufacture can also be carried out without any problem.

Also, in the X-ray tube according to the present invention, the shielding structure may be realized according to a second aspect that differs from the first aspect described above. Specifically, the casing may be constituted of a first anode housing portion and a second anode housing portion, and an inner tubular member may be disposed as the shielding structure in the internal space of the casing. The first anode housing portion is a hollow member comprised of a conductive material, the first anode housing portion surrounding the tip of the anode that has the exhaust port disposed at an inner wall surface thereof and having the irradiation window. The second anode housing portion defines an internal space for housing the anode together with the first anode housing portion, by being joined to the first anode housing portion. The inner tubular member that is the shielding structure of the second mode is a hollow member disposed in the internal space of the casing so as to surround at least the tip of the anode and, by a part thereof being positioned between the inner wall surface of the first anode housing portion and the tip of the anode in a state of being separated by a predetermined distance from the inner wall surface of the first anode housing portion, functions to hide the exhaust port from the tip of the anode.

In the X-ray tube having the above-described shielding structure of the second aspect, the exhaust port, disposed at the inner wall surface of the first anode housing portion, is hidden from the tip of the anode by the inner tubular member, at least a part of which is positioned between the tip of the anode and the inner wall surface of the first anode housing portion. Thus, in this X-ray tube, even when a corner portion appears as a boundary between the edge of the exhaust port and the inner wall surface of the first anode housing portion, disruption of the electric field across the anode and the edge of the exhaust port during driving is alleviated by the inner tubular member. Also, because discharge at the tip of the anode is suppressed effectively, destabilization of X-ray output of the X-ray tube is suppressed. During manufacture of the X-ray tube, vacuuming of the internal space can be performed using a gap between the inner tubular member and the inner wall surface of the first anode housing portion as a passage for air.

Even when the above-described inner tubular member is employed as the shielding structure according to the second mode, a gap is preferably formed between an end of the inner tubular member and an inner wall surface at the irradiation window side of the first anode housing portion. In this configuration, during manufacture of the X-ray tube, vacuum drawing of the internal space can be performed using the gap between the inner tubular member and the inner wall surface at the irradiation window side of the first anode housing portion as a passage for air.

The inner tubular member preferably has a plurality of through holes disposed at least at a part positioned between the inner wall surface of the first anode housing portion and the tip of the anode. In this case, because the through holes themselves serve as passages for air from the internal space during vacuum drawing of the internal space during manufacture, the vacuum drawing can be performed efficiently.

In the X-ray tube according to the present invention, the first anode housing portion preferably has a head comprised of a conductive material, and the second anode housing portion having a bulb comprised of an electrically insulating material and a connecting portion comprised of a conductive material, the connecting portion being joined to an end of the bulb and to the head of the first anode housing portion. In this configuration, the inner tubular member has a shape that extends toward the second anode housing portion side in the internal space so as to hide a joined portion of the bulb and the connecting portion from the anode. That is, in this X-ray tube, discharge occurs comparatively readily across the anode and the joined portion of the bulb comprised of the electrically insulating material, and the connecting portion comprised of the conductive material. Thus, in this X-ray tube, the joined portion is hidden from the anode by employment of the inner tubular member with the above-described structure. Disruption of the electric field across the joined portion and the anode is thus alleviated and the discharge across the joined portion and the anode is suppressed effectively. As a result, destabilization of the X-ray output of the X-ray tube is suppressed.

In the X-ray tube according to the present invention, the second anode housing portion preferably has a bulb comprised of an electrically insulating material, and the first anode housing portion has a head comprised of a conductive material, and a connecting portion comprised of a conductive material, the connecting portion being disposed at an end of the head and joined to the bulb of the second anode housing portion. The inner tubular member preferably has a shape that extends toward the second anode housing portion side in the internal space so as to hide a joined portion of the bulb and the connecting portion from the anode. In the X-ray tube with this structure, discharge occurs comparatively readily across the anode and the joined portion of the bulb comprised of the electrically insulating material, and the connecting portion comprised of the conductive material. Thus, in this X-ray tube, the joined portion is hidden from the anode by employment of the inner tubular member with the above-described structure. Disruption of the electric field across the joined portion and the anode is thus alleviated and the discharge across the joined portion and the anode is suppressed effectively. As a result, destabilization of the X-ray output of the X-ray tube is suppressed.

The inner tubular member may have a loopback portion, at which an end at the second anode housing portion side is looped back into a round shape. In this case, it is preferable that a tip of the loopback portion is joined to the first anode housing portion and a through hole is formed in the loopback portion. In this configuration, because the second anode housing portion side end of the inner tubular member has the round shape, a corner portion with a sharp tip is not formed. Disruption of the electric field across the end and the anode is thus suppressed effectively. As a result, discharge across the end and the anode is suppressed and destabilization of the X-ray output of the X-ray tube can be suppressed. Also, in this case, a space is formed in a region surrounded by the looped back inner tubular member and the first anode housing portion. However, because the through hole formed in the loopback portion serves as a passage for air during vacuum drawing of the internal space in the manufacture of the X-ray tube, retention of air in this space is prevented.

Furthermore, an X-ray source according to the present invention comprises the X-ray tube with the above-described structure (X-ray tube according to the present invention), and a power supply unit supplying a voltage for generating X-rays at the X-ray target toward the anode at which the X-ray target is disposed.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will be apparent to those skilled in the art from this detailed description.

Effects of the Invention

In accordance with the X-ray tube according to the present invention, by employment of a special shielding structure inside the casing, discharge at the tip of the anode is suppressed effectively.

DESCRIPTION OF THE REFERENCE NUMERALS

Figure 1:
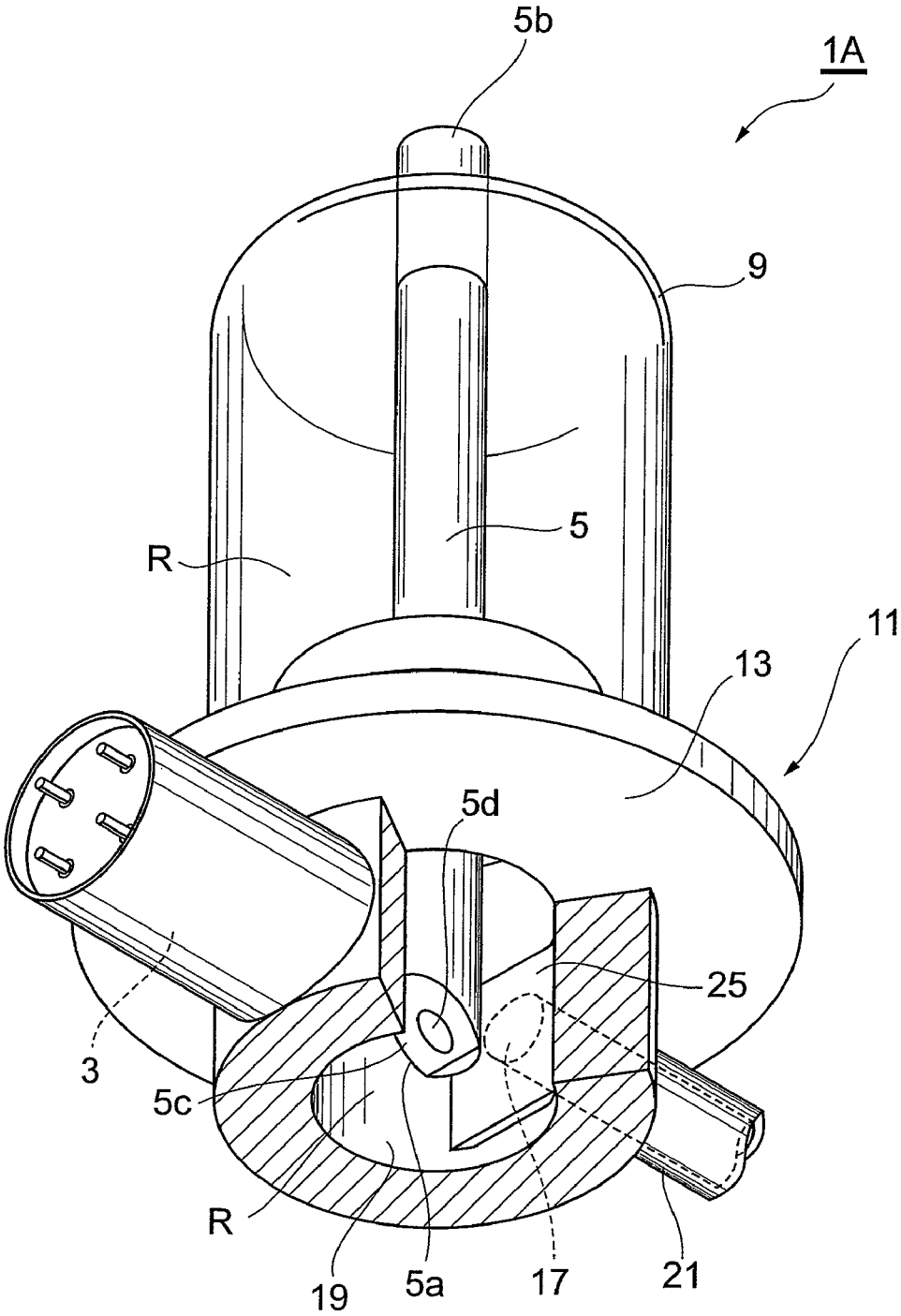
FIG. 1 is a perspective view of an arrangement of a first embodiment of an X-ray tube according to the present invention.

1A, 1B, 1C, 1D, 2A, 2B, 2C, 2D . . . X-ray tube; 3 . . . electron gun; 5 . . . anode; 5*a* . . . anode tip; 9 . . . body portion (second anode housing portion); 9*a* . . . bulb; 9*b* . . . connecting portion; 9*c* . . . fused portion (joined portion); 13 . . . head (first anode housing portion); 14 . . . electron gun housing unit; 15 . . . irradiation window; 17, 57 . . . exhaust port; 19, 59 . . . exhaust port side inner wall surface; 25, 61, 63, 65 . . . shielding member; 29 . . . irradiation window side inner wall surface; 31, 33, 35 . . . inner tubular member; 31*d* . . . loopback portion; 31*e* . . . free end of loopback portion; 31*f* . . . through hole; 31*k* . . . communicating hole; 58 . . . inner wall surface; 61*a*, 63*a* . . . shielding member surface; 63*f*, 65*f* . . . communicating hole; R . . . internal space; d1, d2, d3, d4, S1, S2 . . . gap; 100 . . . X-ray source; 102 . . . power supply unit; 102A . . . insulating block; 102B . . . high voltage generating unit; 102C . . . high voltage line; 102D . . . socket; 103 . . . first plate member; 103A . . . screw insertion hole; 104 . . . second plate member; 104A . . . screw insertion hole; 105 . . . fastening spacer member; 150A . . . screw hole; 106 . . . metal tubular member; 106A . . . mounting flange; 106B . . . relief surface; 106C . . . insertion hole; 108 . . . conductive coating; 109 . . . fastening screw; 110 . . . high voltage insulation oil; XC . . . X-ray camera; SP . . . sample plate; P . . . observation point; and XP . . . X-ray generation point.

BEST MODES FOR CARRYING OUT THE INVENTION

In the following, embodiments of an X-ray tube and an X-ray source, including the X-ray tube according to the present invention will be explained in detail with reference to FIGS. 1 to 20. In the description of the drawings, identical or corresponding components are designated by the same reference numerals, and overlapping description is omitted.

First Embodiment

Figure 2:
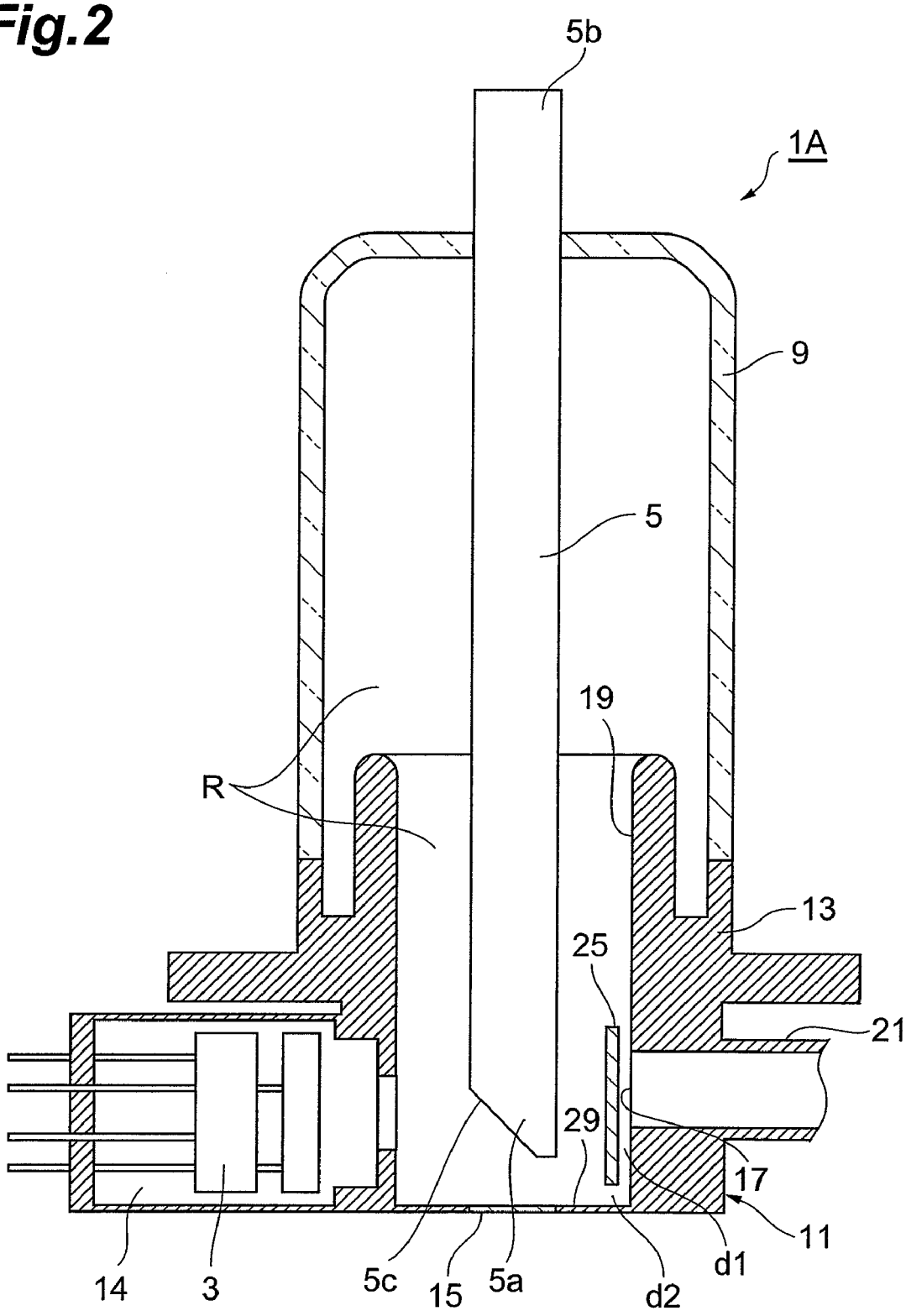
FIG. 2 is a vertical sectional view of the X-ray tube according to the first embodiment shown in FIG. 1.
Figure 3:
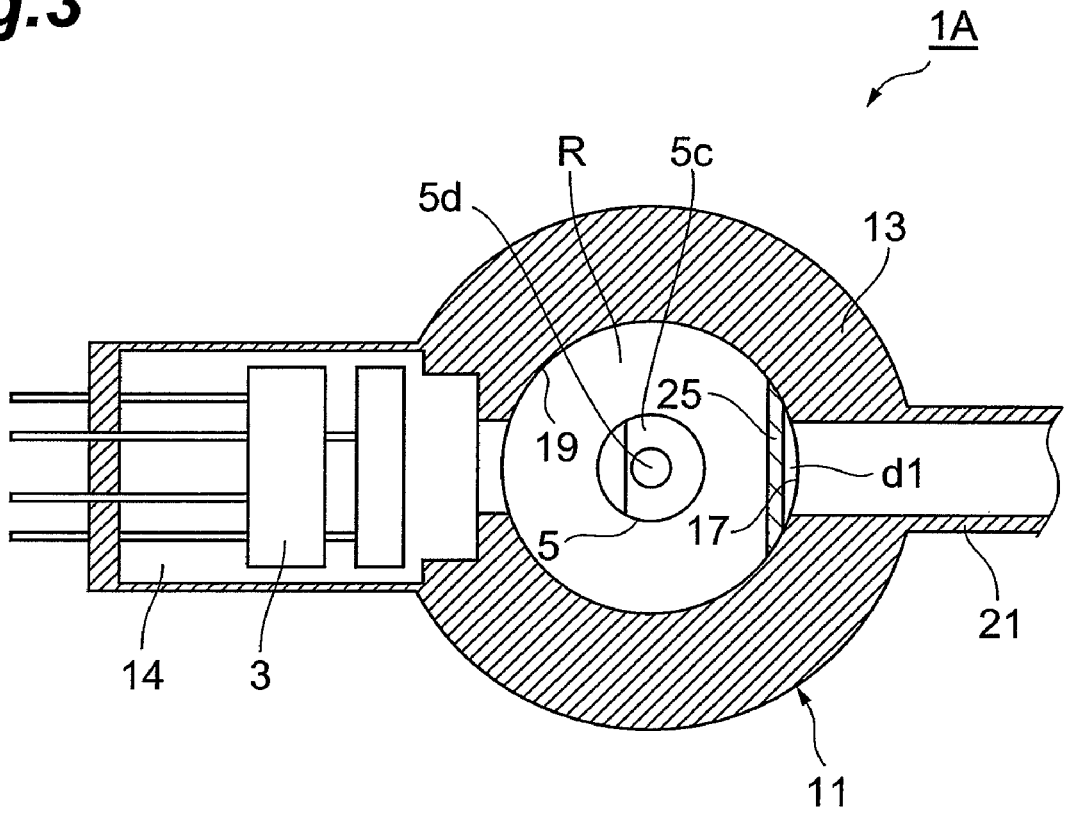
FIG. 3 is a horizontal sectional view of the X-ray tube according to the first embodiment shown in FIG. 1.

First, a first embodiment of an X-ray tube according to the present invention will be explained with reference to FIGS. 1 to 3. FIG. 1 is a perspective view of an arrangement of the first embodiment of the X-ray tube according to the present invention. FIG. 2 is a vertical sectional view of the X-ray tube according to the first embodiment shown in FIG. 1. FIG. 3 is a horizontal sectional view of the X-ray tube according to the first embodiment shown in FIG. 1.

As shown in FIGS. 1 to 3, the X-ray tube 1A makes electrons, emitted from an electron gun 3, be incident on a target 5*d*, which is an electron incidence portion (X-ray generating portion) disposed at a tip 5*a* of an anode 5 in vacuum, and irradiates X-rays, generated as a result of the incidence of electrons, to an exterior. The X-ray tube 1A includes a glass bulb 9, holding the rod-like anode 5 in an insulated state, and an X-ray generating unit 11, housing the anode tip 5*a* and generating X-rays.

The X-ray generating unit 11 has a head 13, which is a metal casing that houses the anode tip 5*a*, and substantially the entirety of the anode 5 is housed in a sealed internal space R, defined by the head 13 and the bulb 9, in a state of being insulated from the head 13. An inclined surface 5*c* is disposed at an end surface of the anode tip 5*a*, and on the inclined surface 5*c* is disposed the target 5*d* that generates X-rays with a desired energy upon the incidence of electrons. The anode tip 5*a* is surrounded by an inner wall surface 19 of the head 13 forming a cylindrical surface coaxial to the anode 5. The electron gun 3 is housed in an electron gun housing unit 14, mounted onto the head 13, and a tip of the electron gun 3 is directed toward the anode tip 5*a*. That is, an axial line of the electron gun 3 and an axial line of the anode 5 are made substantially orthogonal to each other so that the electrons emitted from the electron gun 3 are made incident on the target 5*d* on the inclined surface 5*c*, formed so as to face the electron gun 3. Furthermore, at an end at the anode tip 5*a* side of the head 13 is disposed a circular irradiation window 15 (X-ray emitting window) comprised of a material of high X-ray transmittance for transmitting the X-rays generated at the target 5*d* and thereby irradiating the X-rays to the exterior.

In order to put the internal space R in a vacuum state (a state of being decompressed to a predetermined degree of vacuum), an exhaust port 17, for evacuating air inside the internal space R, is disposed at the inner wall surface 19 of the head 13. On the other hand, an exhaust tube 21, put in communication with the internal space R via the exhaust port 17, is mounted on an outer wall surface of the head 13. In manufacturing the X-ray tube, by performing vacuum drawing of the internal space R via the exhaust port 17 and the exhaust tube 21 and thereafter closing the tube opening by squashing the exhaust tube 21, etc., the internal space R is sealed in a vacuum state. In this process, the exhaust port 17 is left open to the internal space R even after completion of assembly of the X-ray tube.

In the X-ray tube 1A, a base end 5*b* (high voltage application portion) of the anode 5, exposed from the bulb 9, is connected to a high voltage supply circuit. During driving, a high voltage of approximately 100 kV is applied from the high voltage supply circuit to the anode 5 via the base end 5*b*. When the electrons emitted from the electron gun 3 in this state become incident on the target 5*d*, X-rays are generated from the target 5*d* by the incidence of electrons. The generated X-rays are transmitted through the irradiation window 15 and irradiated to the exterior.

Because the high voltage is thus applied to the anode 5 during driving, a high potential difference arises across the anode 5 and the head 13, which is the metal casing. In particular, because the anode tip 5*a* is housed so as to be surrounded by the head 13, there is a problem of discharge occurring across the anode tip 5*a* and the inner wall surface 19 of the head 13. Here, at an edge of the exhaust port 17, formed in the inner wall surface 19, a corner portion with a sharp tip is present as a boundary with the inner wall surface 19. An electric field across the anode 5 and the head 13 is disrupted due to an influence of the corner portion, and consequently, there is an especially high possibility of discharge occurring across the edge of the exhaust port 17 and the anode tip 5*a*. Because when the discharge occurs, problems, such as destabilization of an X-ray output of the X-ray tube 1A, occur, the discharge must be suppressed.

Thus, in the X-ray tube 1A, in order to suppress the discharge across the edge of the exhaust port 17 and the anode tip 5*a*, a special shielding structure (first mode) is employed. That is, a partitioning-screen-like shielding member 25, hiding the exhaust port 17 from the anode tip 5*a*, is disposed between the anode tip 5*a* and the exhaust port 17. The shielding member 25 is a flat plate member comprised of a conductive material, the shielding member 25 being processed to a rectangular shape and having an area larger than an open aperture of the exhaust port 17. The shielding member 25 has two opposing sides fixed to the inner wall surface 19 and is disposed so as to cover the exhaust port 17 across a gap d1 from the inner wall surface 19 at a central portion. The shielding member 25 extends very close to an inner wall surface 29, on which the irradiation window 15 is disposed, so that a small gap d2 is formed between the shielding member 25 and the inner wall surface 29. By the shielding member 25, the edge of the exhaust port 17 is prevented from being viewed from the anode tip 5*a*.

In the X-ray tube 1A, by such a shielding member 25 being disposed, disruption of the electric field across the anode tip 5*a* and the edge of the exhaust port 17 is alleviated. Discharge across the anode tip 5*a* and the edge of the exhaust port 17 is thus suppressed. Also, by the gaps d1 and d2, an interior of the exhaust tube 21 and the internal space R are put in communication, and because the gaps d1 and d2 function as passages for air, vacuum drawing of the internal space R via the exhaust port 17 can be performed without any problem during manufacture. Although vacuum drawing will take some time, the shielding member 25 may be disposed so that the gap d2 is not formed. In this case, vacuum drawing can be performed using just the gap d1 as a passage for air. The shielding member 25 is not limited to being a flat plate member and may be a curved plate member with a curvature larger than that of the inner wall surface of the head 13.

(First Modification Example of the X-ray Tube According to the First Embodiment)

Figure 4:
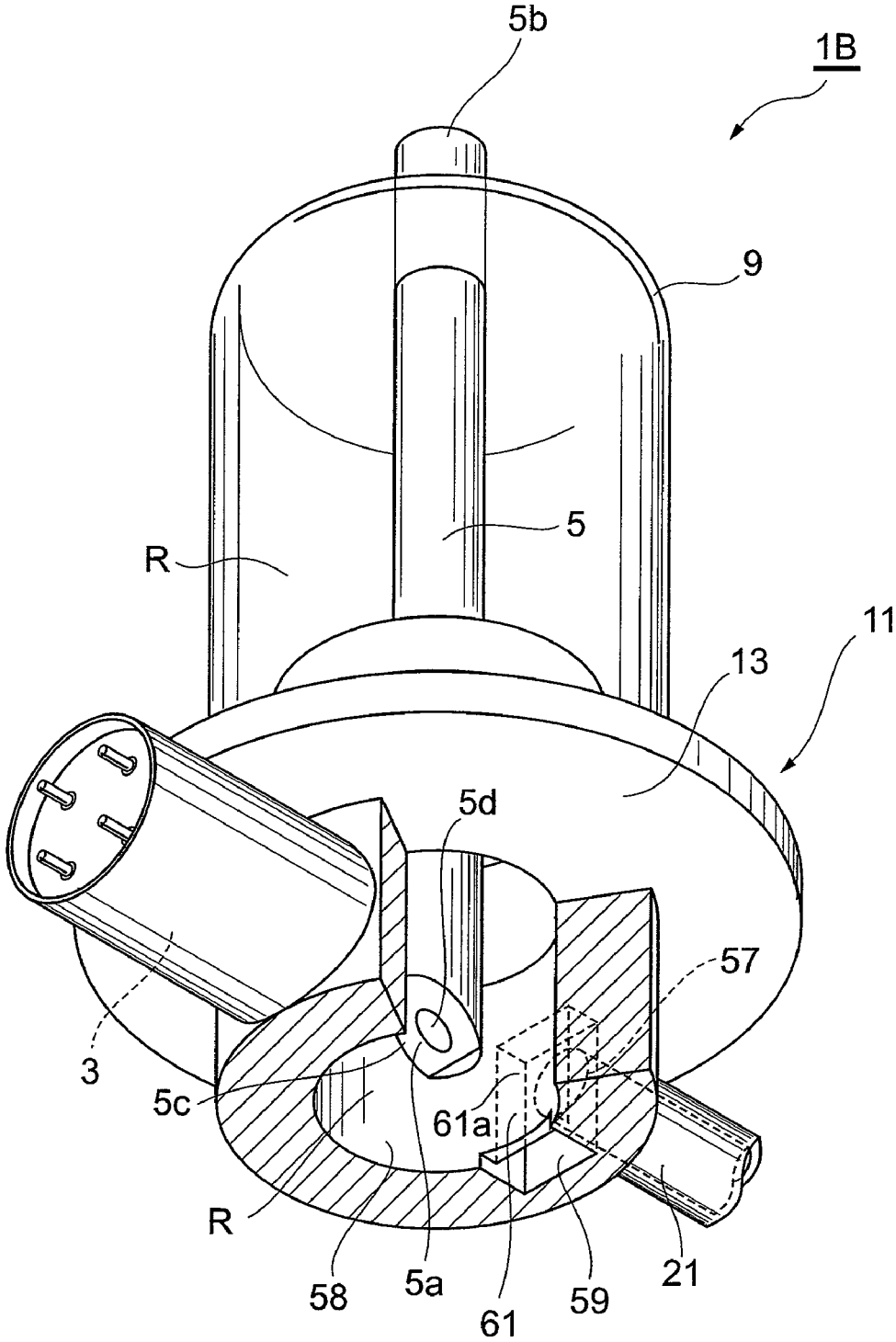
FIG. 4 is a perspective view of an arrangement of a first modification example of the X-ray tube according to the first embodiment.
Figure 5:
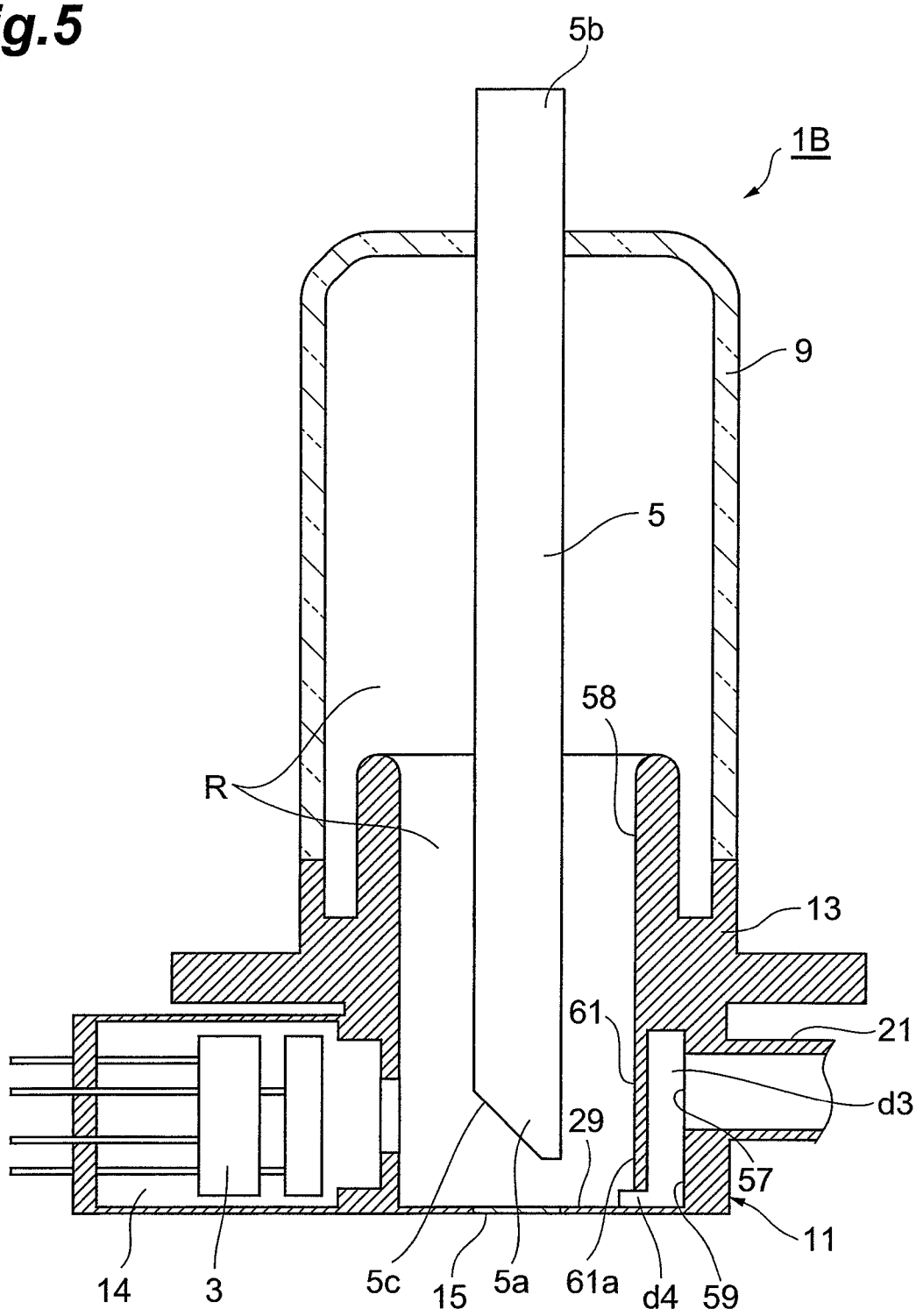
FIG. 5 is a sectional view of the X-ray tube shown in FIG. 4 (first modification example of the X-ray tube according to the first embodiment)

Subsequently, a first modification example of the X-ray tube according to the first embodiment will be explained with reference to FIGS. 4 and 5. FIG. 4 is a perspective view of an arrangement of the first modification example of the X-ray tube according to the first embodiment. FIG. 5 is a sectional view of the X-ray tube 1B shown in FIG. 4.

The X-ray tube 1B, shown in FIGS. 4 and 5, differs from the X-ray tube 1A of the first embodiment in a shielding member structure that hides an exhaust port 57 from the anode tip 5*a*. In the X-ray tube 1B, the exhaust port 57 is positioned at an inner wall surface 59 formed by digging into a part of an inner wall surface 58 in a direction of an outer wall surface of the head 13. A shielding member 61 for hiding the exhaust port 57 from the anode tip 5*a* is disposed between the exhaust port 57 and the anode tip 5*a*. The shielding member 61 has an inner side surface 61*a*, facing the anode tip 5*a* and being matched with the inner wall surface 58 (and being practically a part of the head 13 in the present modification example), and has a rectangular shape with an area larger than the open aperture of the exhaust port 57. The shielding member 61 is disposed so that a gap d3 is formed across from the exhaust port 57. The shielding member 61 extends very close to an inner wall surface 29, on which the irradiation window 15 is disposed, so that a small gap d4 is formed between the shielding member 61 and the inner wall surface 29. By the shielding member 61, the edge of the exhaust port 57 is prevented from being viewed from the anode tip 5*a*.

The shielding member 61 and the exhaust port 57 with the above-described structure is prepared by carving out a region of rectangular parallelepiped shape sandwiched between the shielding member 61 and the inner wall surface 59 in the head 13 while leaving the shielding member 61 and thereafter forming the exhaust port 57 and the gap d4. Or, the inner wall surface 59 may be formed by digging into the inner wall surface 58 and, after forming the exhaust port 57 in the inner wall surface 59, installing the shielding member 61 as a separate member so that its inner side surface is matched with the inner wall surface 58.

In the X-ray tube 1B, by the provision of the shielding member 61, disruption of an electric field across the anode tip 5*a* and the exhaust port 57 is alleviated. Discharge across the anode tip 5*a* and the edge of the exhaust port 57 can thus be suppressed. Also, by the gaps d3 and d4, the interior of the exhaust tube 21 and the internal space R are put in communication, and because the gaps d3 and d4 function as passages for air, vacuum drawing of the internal space R via the exhaust port 57 can be performed without any problem during manufacture. Also, by the inner side surface 61*a* of shielding member 61 being matched with the inner wall surface 58 that surrounds the anode tip 5*a*, the inner side surface 61*a* of the shielding member 61 is made smoothly continuous with the inner wall surface 58. In this configuration, disruption of the electric field around the target tip 5*a* due to the shielding member 61 can thus be minimized.

(Second Modification Example of the X-ray Tube According to the First Embodiment)

Figure 6:
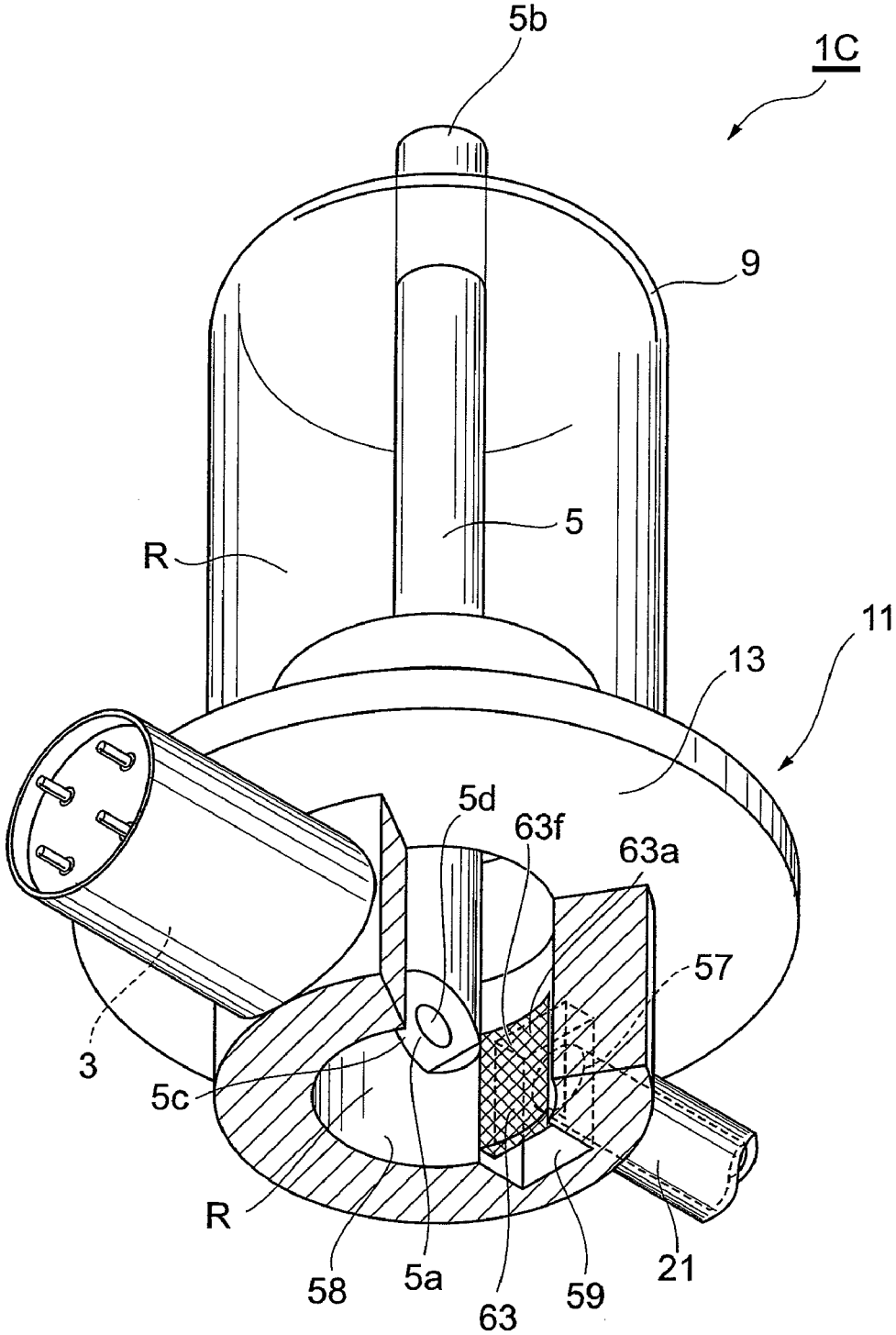
FIG. 6 is a perspective view of an arrangement of a second modification example of the X-ray tube according to the first embodiment.
Figure 7:
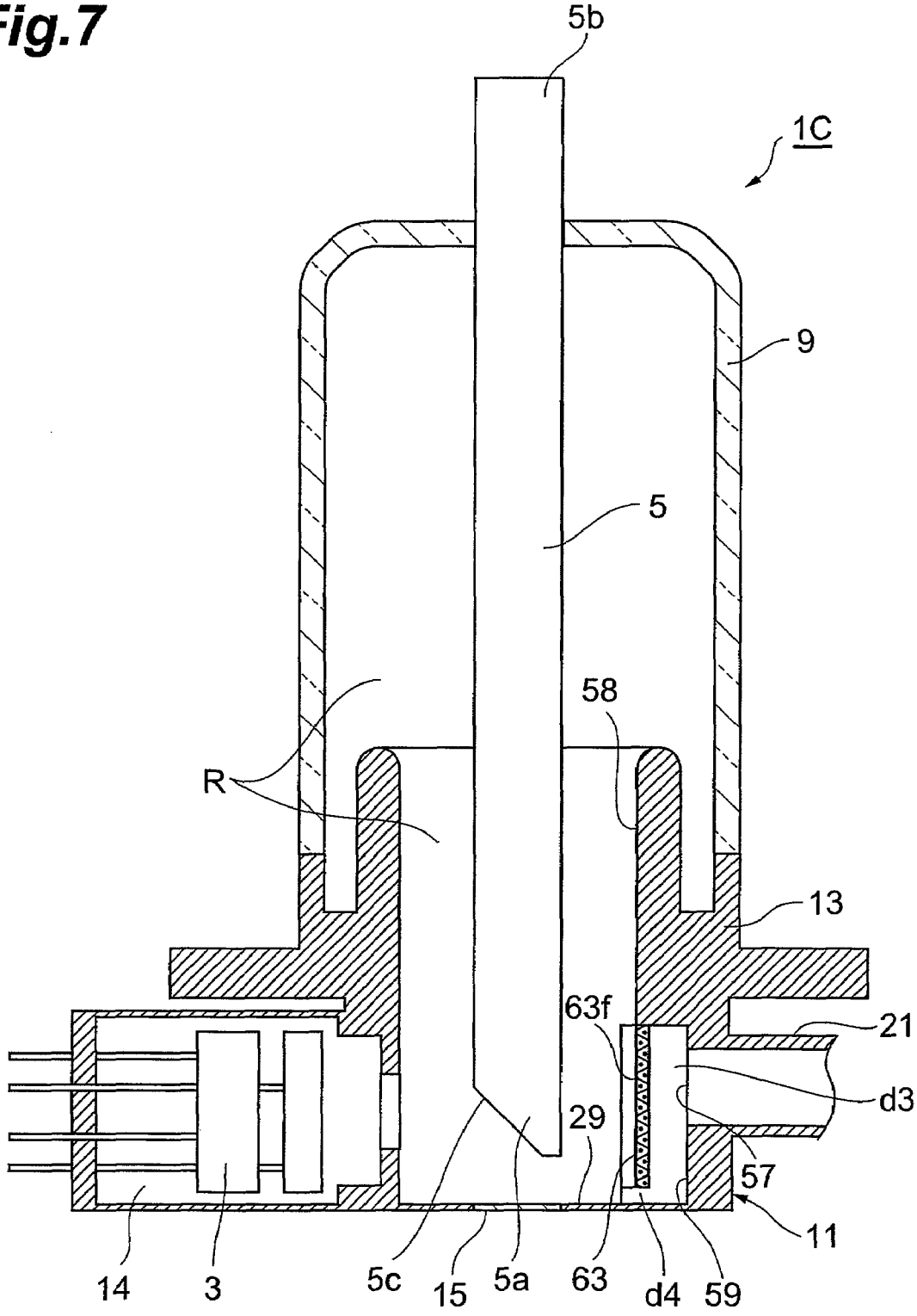
FIG. 7 is a sectional view of the X-ray tube shown in FIG. 6 (second modification example of the X-ray tube according to the first embodiment)

Subsequently, a second modification example of the X-ray tube according to the first embodiment will be explained with reference to FIGS. 6 and 7. FIG. 6 is a perspective view of an arrangement of the second modification example of the X-ray tube according to the first embodiment. FIG. 7 is a sectional view of the X-ray tube 1C shown in FIG. 6.

The X-ray tube 1C, shown in FIGS. 6 and 7 differs from the X-ray tube 1B of the second embodiment in a structure of a shielding member 63. The shielding member 63 is a mesh-like conductive member provided with a plurality of through holes 63*f* and has the same shape as the above-described shielding member 61. The shielding member 63 is formed so that an inner side surface 63*a*, facing the anode tip 5*a*, is matched with the inner wall surface 58 that surrounds the anode tip 5*a*.

Even in accordance with the shielding member 63, by making the through holes 63*f* fine, disruption of the electric field across the anode tip 5*a* and the edge of the exhaust port 57 is alleviated in similar to the shielding member 61 in the X-ray tube 1B. Discharge across the anode tip 5*a* and the edge of the exhaust port 57 can thus be suppressed effectively with the X-ray tube 1C as well. Because in the process of vacuum drawing of the internal space R during manufacture not only the gaps d3 and d4 but the through holes 63*f* also function as passages for air, smooth vacuum drawing is enabled. As a hole diameter of the through holes 63*f*, 0.1 to 1 mm is preferable for alleviating the disruption of the electrical field and performing smooth vacuum drawing.

(Third Modification Example of the X-ray Tube According to the First Embodiment)

Figure 8:
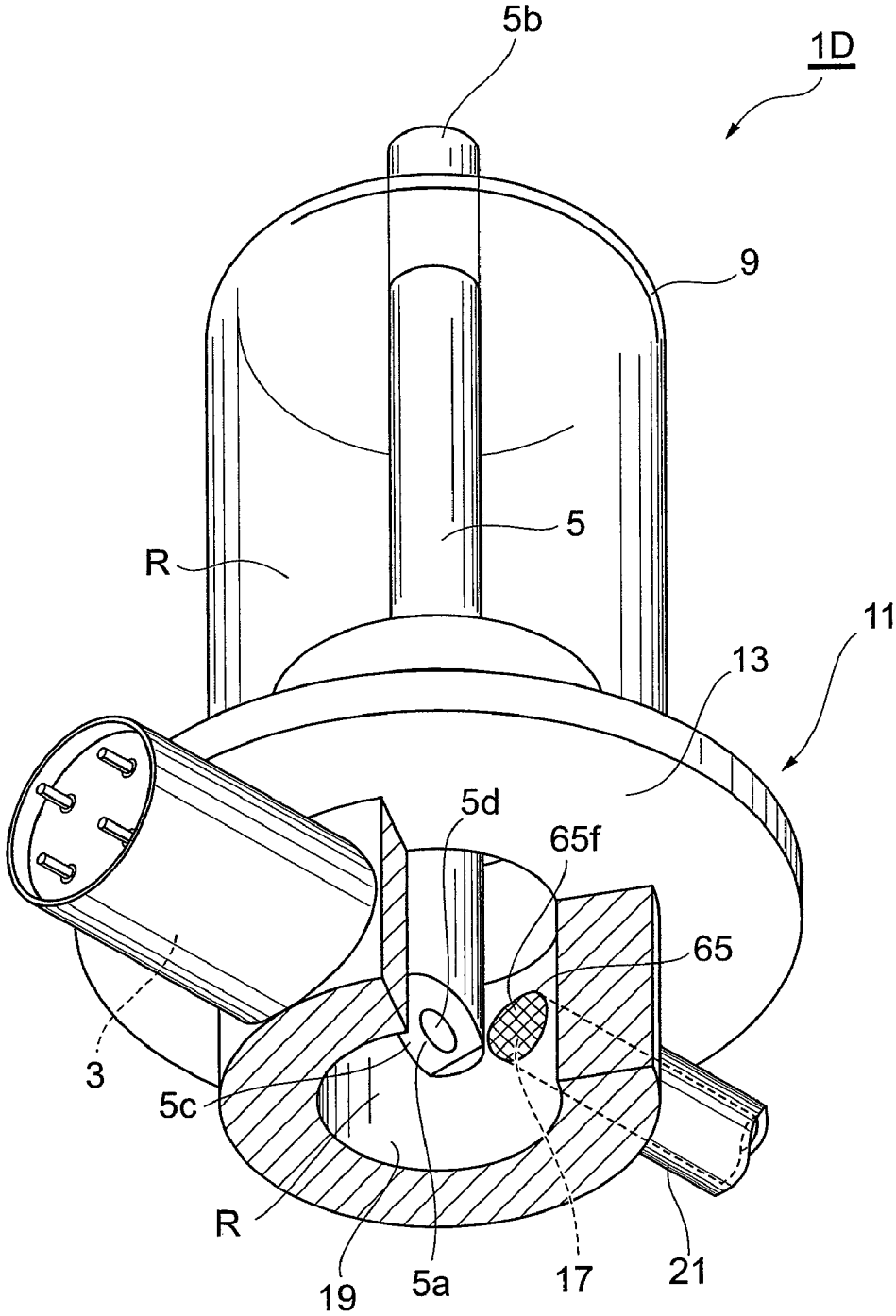
FIG. 8 is a perspective view of an arrangement of a third modification example of the X-ray tube according to the first embodiment.
Figure 9:
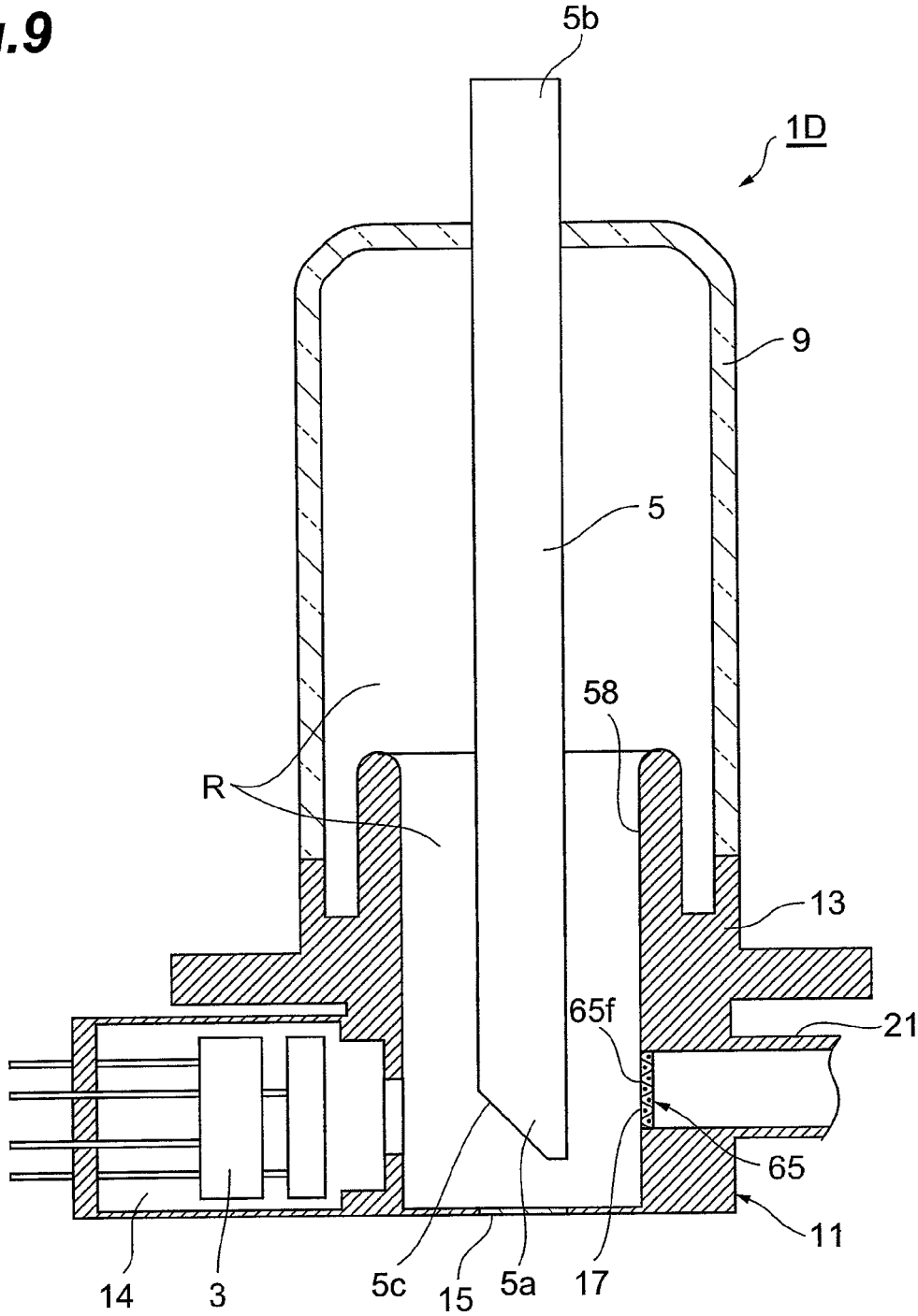
FIG. 9 is a sectional view of the X-ray tube shown in FIG. 8 (third modification example of the X-ray tube according to the first embodiment)

A third modification example of the X-ray tube according to the first embodiment shall now be described with reference to FIGS. 8 and 9. FIG. 8 is a perspective view of an arrangement of the third modification example of the X-ray tube according to the first embodiment. FIG. 9 is a sectional view of the X-ray tube 1D shown in FIG. 8.

The X-ray tube 1D, shown in FIGS. 8 and 9, differs from the X-ray tube 1A of the first embodiment in a structure of a shielding member that hides the exhaust port 17 from the anode tip 5*a*. The shielding member 65 is a mesh-like conductive member, provided with a plurality of through holes 65*f* and disposed so as to close the exhaust port 17 while an inner side surface, facing the anode 5, is matched with the inner wall surface 19.

In the shielding member 65, because an end portion does not appear at the inner wall surface 19 at the edge of the exhaust port 17, disruption of the electric field across the anode tip 5*a* and the edge of the exhaust port 17 is alleviated. Discharge across the anode tip 5*a*and the edge of the exhaust port 17 can thus be suppressed. Also, the interior of the exhaust tube 21 and the internal space R are put in communication by the plurality of through holes 65*f*, provided in the shielding member 65, and the through holes 65*f* function as passages for air. Vacuum drawing of the internal space R via the exhaust port 17 can thus be performed without any problem during manufacture. As a hole diameter of the through holes 65*f*, 0.1 to 1 mm is preferable for alleviating the disruption of the electrical field and performing smooth vacuum drawing.

The present invention is not restricted to the above-described first embodiment and modification examples thereof and can be modified variously. For example, although the target 5*d* is disposed as a separate member on the inclined surface 5*c* of the anode 5, the anode 5 and the target 5*d* can be configured integrally so that a part of the inclined surface 5*c* constitutes the target. Also, although the anode 5 has a shape having the inclined surface 5*c* disposed at the tip of a cylindrical column, other shapes can be provided at the tip of the anode 5 by any of various types of carving. In this case, even if a corner-like portion is present at the tip of the anode, discharge across the anode tip and the exhaust port can be suppressed effectively by the shielding member.

Second Embodiment

Figure 10:
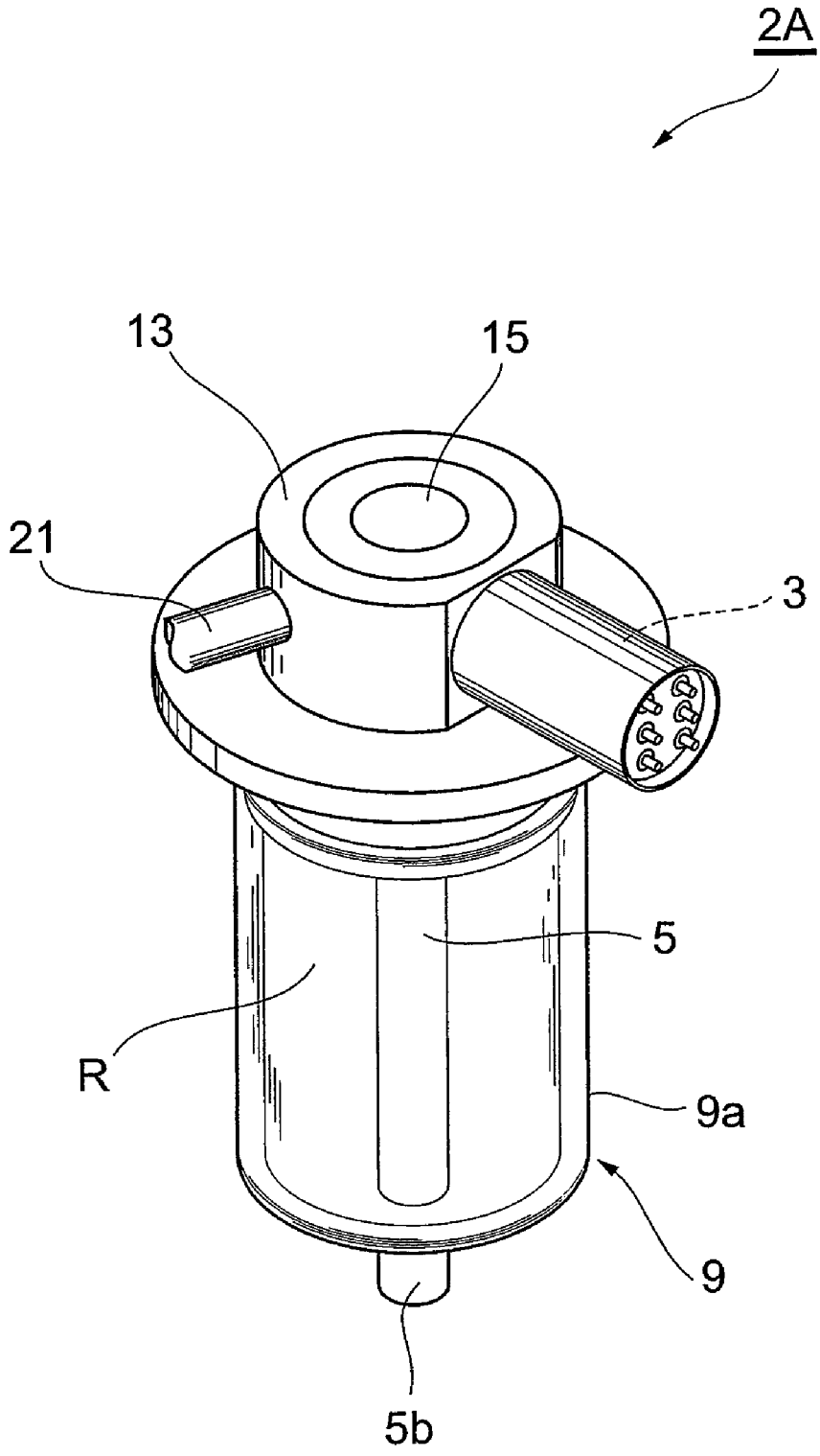
FIG. 10 is a perspective view of an arrangement of a second embodiment of an X-ray tube according to the present invention.
Figure 11:
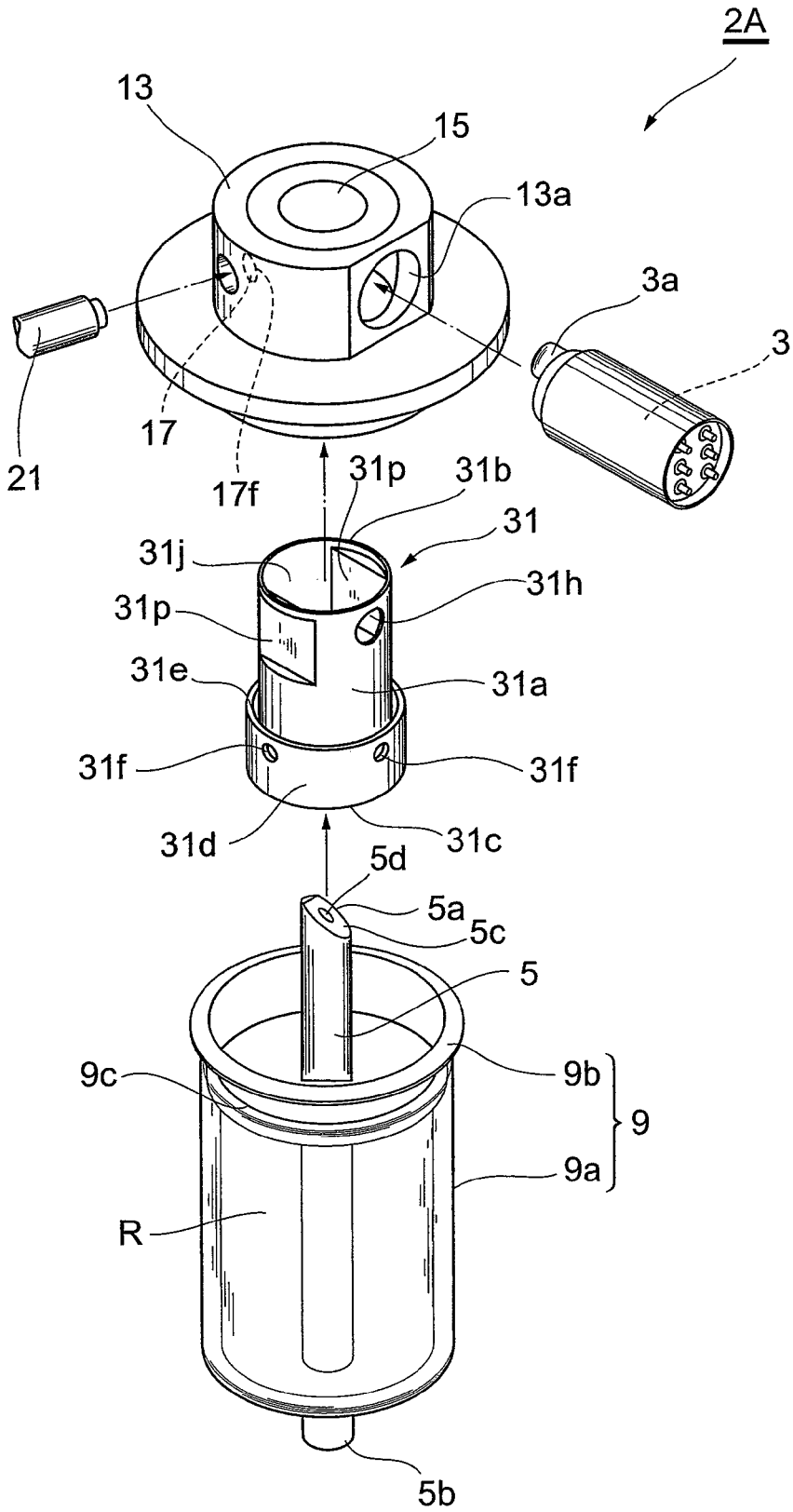
FIG. 11 is an exploded perspective view of the X-ray tube according to the second embodiment shown in FIG. 10.
Figure 12:
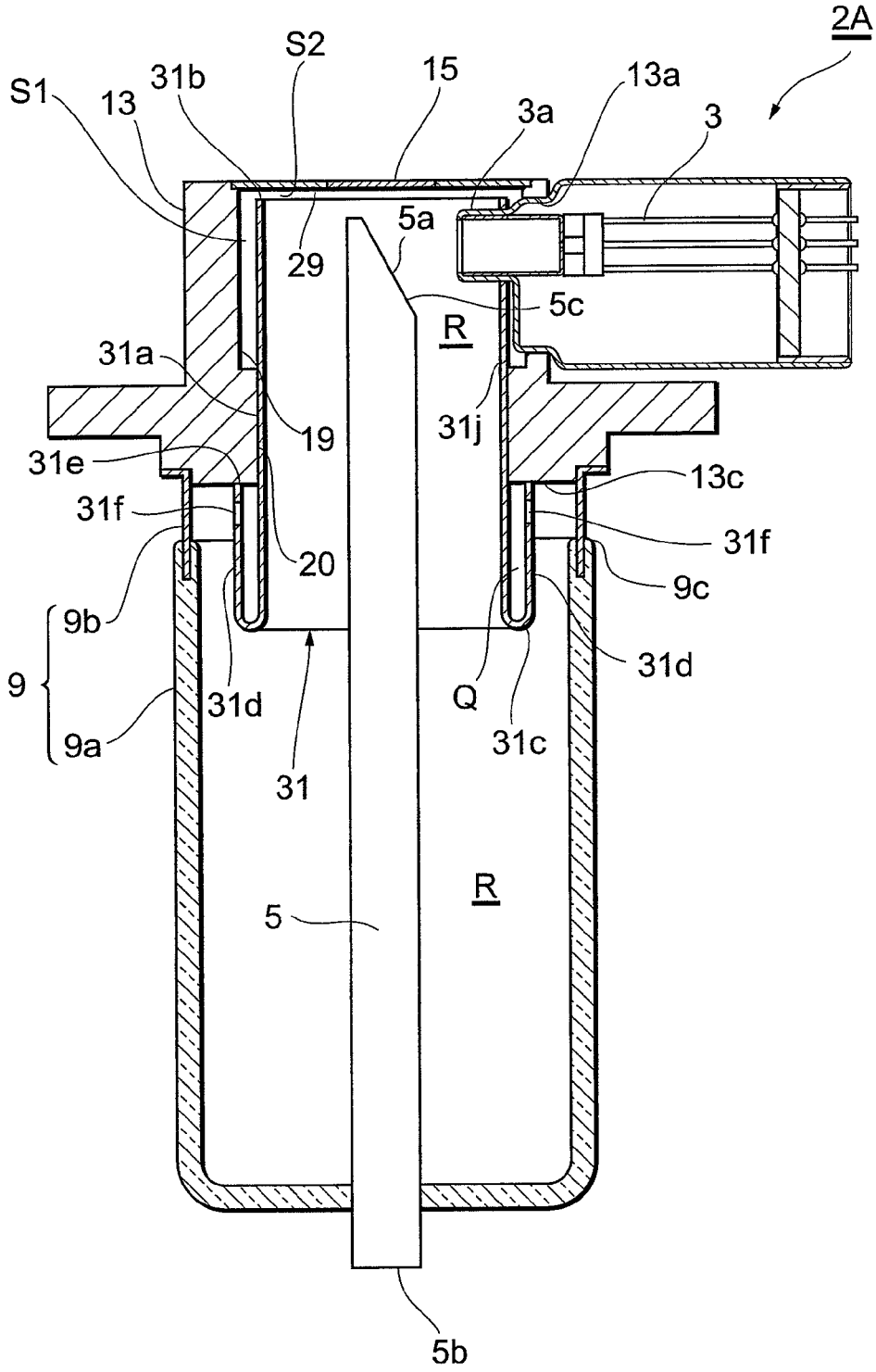
FIG. 12 is a sectional view of the X-ray tube according to the second embodiment shown in FIG. 10.
Figure 13:
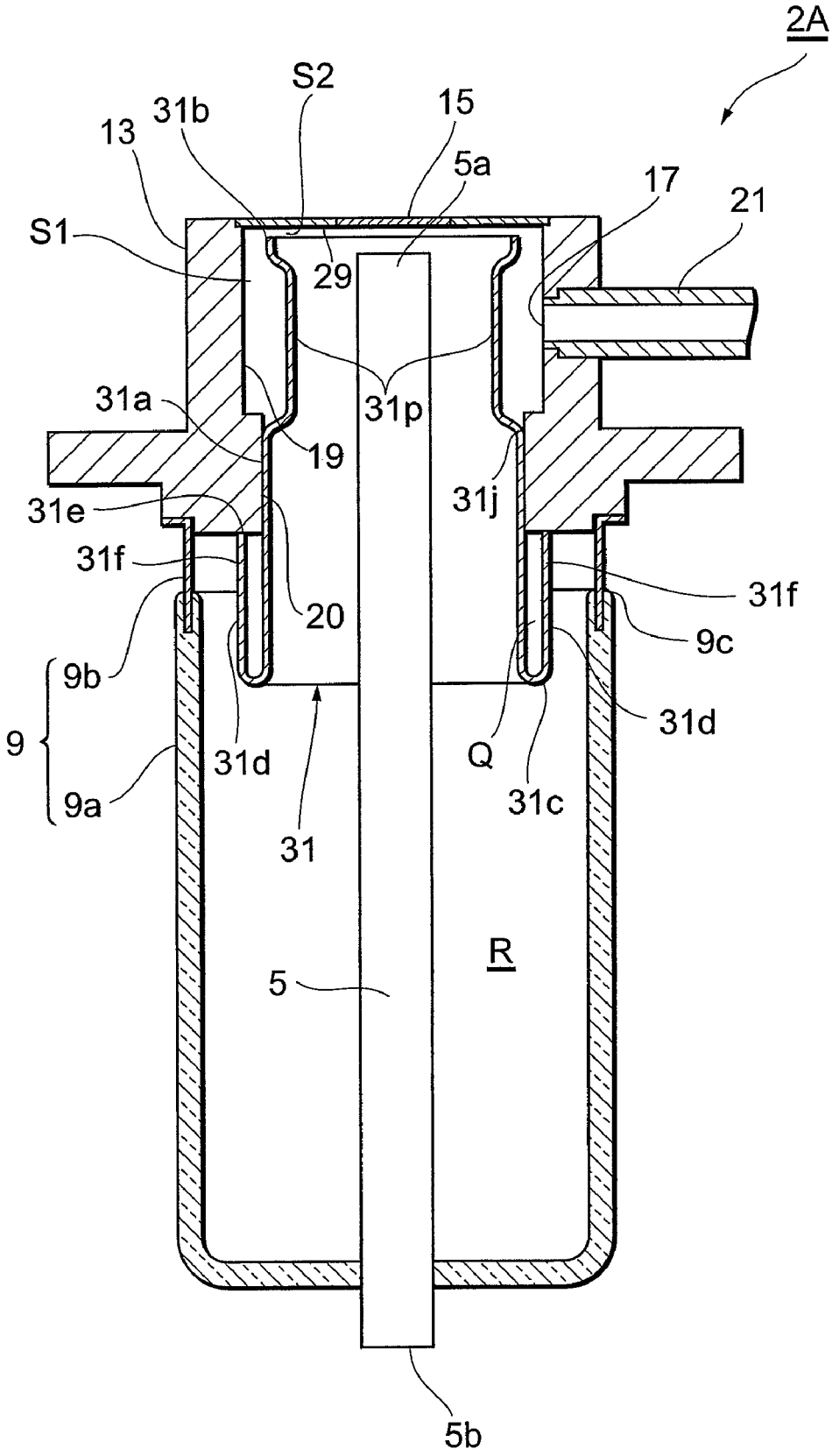
FIG. 13 is a sectional view taken across a central axis of an exhaust tube of the X-ray tube according to the second embodiment shown in FIG. 10.
Figure 14:
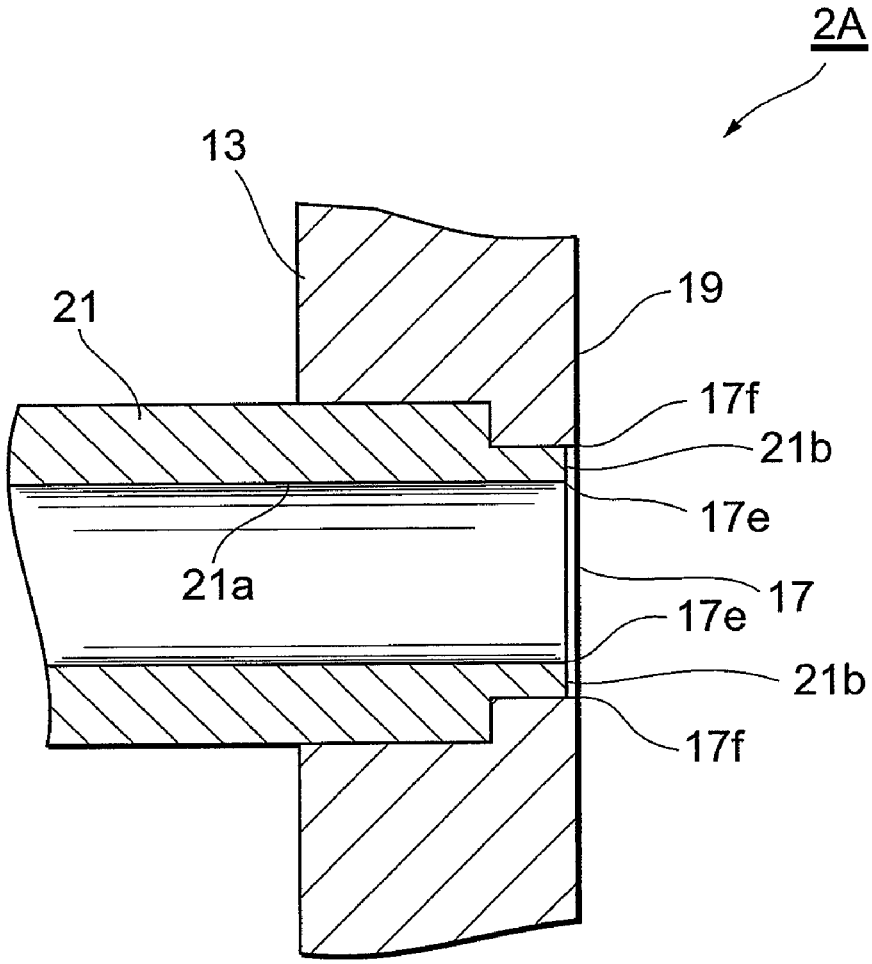
FIG. 14 is a sectional view of a vicinity of a mounting portion of the exhaust tube of the X-ray tube according to the second embodiment shown in FIG. 10.

Next, an arrangement of a second embodiment of an X-ray tube according to the present invention will be explained with reference to Vs. 10 to 14. FIG. 10 is a perspective view of the arrangement of the second embodiment of the X-ray tube according to the present invention. FIG. 11 is an exploded perspective view of the X-ray tube 2A according to the second embodiment shown in FIG. 10. FIG. 12 is a sectional view of the X-ray tube 2A according to the second embodiment shown in FIG. 10. FIG. 13 is a sectional view taken across a central axis of an exhaust tube of the X-ray tube 2A according to the second embodiment shown in FIG. 10. FIG. 14 is a sectional view of a vicinity of a mounting portion of the exhaust tube of the X-ray tube 2A according to the second embodiment shown in FIG. 10.

As shown in FIGS. 10 to 13, in similar to the X-ray tube 1A according to the first embodiment, the X-ray tube 2A makes electrons, emitted from the electron gun 3, be incident on the target 5*d*, which is the electron incidence portion (X-ray generating portion) disposed at the tip 5*a* of the anode 5 in vacuum, and irradiates X-rays, generated as the result of the incidence of electrons, to the exterior. The X-ray tube 2A includes a body portion (second anode housing portion) 9, holding the rod-like anode 5 in an insulated state, and the head (first anode housing portion) 13, which is the metal casing that surrounds the anode tip 5*a*. The body portion 9 is constituted of a bulb 9*a* comprised of glass, which is an electrically insulating material, and a connecting portion 9*b* connecting the bulb 9*a* and the head 13. One end side of the bulb 9*a* is open and the other end side holds the anode 5. At the open side of the bulb 9*a*, one end of the cylindrical connecting portion 9*b*, which is comprised of metal, is joined by fusing. An outwardly extending flange is disposed at the other end of the connecting portion 9*b*, and the connecting portion 9*b* is welded to the head 13 at this flange. That is, the bulb 9*a* and the head 13 are connected via the connecting portion 9*b*. By the bulb 9*a*, the head 13, and the connecting portion 9*b* that are thus connected, the sealed internal space R is defined. Substantially the entirety of the anode 5 is housed inside the internal space R in a state of being insulated from the head 13 and the connecting portion 9*b*. The inclined surface 5*c* is disposed at the anode tip 5*a*, and on the inclined surface 5*c* is disposed the target 5*d* that generates the X-rays with the desired energy upon the incidence of electrons.

As another example, the first anode housing portion may be configured by integrally disposing the tubular connecting portion 9*b*, for fusing with the bulb 9*a*, at an end of the head 13. In this case, the bulb 9*a* constitutes the second anode housing portion.

The head 13 has inner wall surfaces 19 and 20, constituting cylindrical surfaces coaxial to the anode 5, and the anode tip 5*a* is surrounded by the inner wall surfaces 19 and 20. The electron gun housing unit 14, housing the electron gun 3, is mounted to a mounting hole 13*a*, formed so as to penetrate through a side wall of the head 13. The electron gun 3 is positioned while the axial line of the electron gun 3 and the axial line of the anode 5 are made substantially orthogonal to each other. That is, the tip of the electron gun 3 is directed toward the anode tip 5*a* so that the electrons emitted from the electron gun 3 are made incident on the target 5*d* on the inclined surface 5*c*, formed so as to face the electron gun 3. Furthermore, at the end at the anode tip 5*a* side of the head 13, which is the metal casing, is disposed the circular irradiation window 15 (X-ray emitting window) comprised of a material of high X-ray transmittance for transmitting the X-rays generated at the target 5*d* and thereby irradiating the X-rays to the exterior.

In order to put the internal space R in a vacuum state (a state of being decompressed to a predetermined degree of vacuum), the exhaust port 17, for evacuating air inside the internal space R, is disposed at the inner wall surface 19 of the head 13. Furthermore, the exhaust tube 21, put in communication with the internal space R via the exhaust port 17, is mounted on the outer wall surface of the head 13. In manufacturing the X-ray tube, by performing vacuum drawing of the internal space R via the exhaust port 17 and the exhaust tube 21 and thereafter closing the tube opening by squashing the exhaust tube 21, etc., the internal space R is sealed in a vacuum state. In this process, the exhaust port 17 is left open to the internal space R even after completion of assembly of the X-ray tube. Although, in the present embodiment, the exhaust port 17 is formed at an inner wall surface 19 position diagonally in front of the mounting hole 13*a*, the exhaust port 17 may be formed at any position of the inner wall surface 19 or 20.

In the X-ray tube 2A, the base end 5*b* (high voltage application portion) of the anode 5, exposed from the bulb 9, is connected to the high voltage supply circuit. During driving, the high voltage of approximately 100 kV is applied from the high voltage supply circuit to the anode 5, including the target 5*d*, via the base end 5*b*. When the electrons emitted from the electron gun 3 in this state become incident on the target 5*d*, X-rays are generated from the target 5*d* by the incidence of electrons. The generated X-rays are transmitted through the irradiation window 15 and irradiated to the exterior. In similar to the first embodiment, the terms, "upper," "lower," etc., are used with the irradiation window 15 side being the upper side and the base end 5*b* side of the anode 5 being the lower side in the description of the second embodiment as well.

Because the high voltage is thus applied to the anode 5 during driving, a high potential difference arises across the anode 5 and the head 13. In particular, the anode tip 5*a* is housed so as to be surrounded by the head 13. There is thus a problem of discharge occurring across the anode tip 5*a* and the inner wall surface 19 of the head 13. Here, as shown in FIG. 14, at the edge of the exhaust port 17, formed in the inner wall surface 19, an abrupt corner portion 17*e* appears at a boundary between an inner wall surface 21*a* of the exhaust tube 21 and an end surface 21*b* of the exhaust tube 21 and an abrupt corner portion 17*f* appears at a boundary between the exhaust port 17 and the inner wall surface 19. The electric field across the anode 5 and the head 13 is disrupted due to influence of the corner portions 17*e* and 17*f*. Consequently, there is an especially high possibility of discharge occurring across the edge of the exhaust port 17 and the anode tip 5*a*. Because when the discharge occurs, problems, such as destabilization of the X-ray output of the X-ray tube 2A, occur, the discharge must be suppressed.

Thus, in the X-ray tube 2A, in order to suppress the discharge across the edge of the exhaust port 17 and the anode tip 5*a*, a special shielding structure (second mode) is employed. That is, an inner tubular member 31 is disposed between the inner wall surface 19 of the head 13 and the anode tip 5*a*. The inner tubular member 31 is a conductive member comprised of metal and has a thickness thinner than the head 13, the inner tubular member 31 having a cylindrical shape that surrounds the anode tip 5*a*. By the provision of such an inner tubular member 31, in the X-ray tube 2A, the exhaust port 17 is hidden from the anode tip 5*a*. That is, the edge of the exhaust port 17 is prevented from being viewed from the anode tip 5*a*.

The inner wall surface 20, coaxial to the inner wall surface 19 of the head 13 and constituting a cylindrical surface slightly smaller in diameter than the inner wall surface 19, is formed below the inner wall surface 19. On the other hand, an outer diameter of the inner tubular member 31 is set substantially equal to an inner diameter of the head 13 at the inner wall surface 20. By an outer wall surface 31*a* of the cylindrical portion 31 contacting the inner wall surface 20 across its entire periphery, the cylindrical portion 31 is disposed so as to be coaxial to the anode 5 and the inner wall surface 19 of the head 13. By this positional relationship, a small gap S1 is formed between the outer wall surface 31*a* of the inner tubular member 31 and the inner wall surface 19 of the head 13. Furthermore, the inner tubular member 31 extends very close to the inner wall surface 29, on which the irradiation window 15 is disposed, so that a small gap S2 is formed between an upper end 31*b* of the inner tubular member 31 and the inner wall surface 29. By the above structure, the internal space R is put in communication with the interior of the exhaust tube 21 via the gaps S1 and S2, and in the process of vacuum drawing of the internal space R, the gaps S1 and S2 function as passages for air.

A lower end 31*c* side of the inner tubular member 31 protrudes from a lower end of the head 13 and extends below a fused portion (joined portion) 9*c* of the bulb 9*a* and the connecting portion 9*b*. By this structure, the inner tubular member 31 is made present between the fused portion 9*c* and the target 5. The fused portion 9*c* is thus hidden from view from the anode 5 by the inner tubular member 31. The lower end 31*c* of the inner tubular member 31 is looped back into a round shape with a curved surface and a free end 31*e* of a loopback portion 31*d* facing the bulb 9*a* side is joined by brazing to a lower end surface 13*c* of the head 13.

Because the lower end 31*c* of the inner tubular member 31 is thus looped back into the round shape, a corner portion does not appear at the lower end of the inner tubular member 31. Disruption of an electric field across the inner tubular member lower end 31*c* and the anode 5 is thus suppressed, and discharge across the lower end 31*c* of the inner tubular member and the anode 5 can be suppressed effectively. Also, by the lower end 31*c* of the inner tubular member being looped back, a small space Q, surrounded by the looped back inner tubular member 31 and the lower end surface 13*c* of the head 13, is formed. Through holes 31*f*, for putting the small space Q in communication with the internal space R are thus formed in the loopback portion 31*d*. The through holes 31*f* thus serve as passages for air during vacuum drawing of the internal space R and retention of air in the small space Q is prevented.

In the inner tubular member 31, an insertion hole 31*h* is formed at a position corresponding to the electron gun 3, and a tip 3*a* of a housing container that houses the electron gun 3 is inserted into the insertion hole 31*h* and becomes exposed at the anode tip 5*a* side. A pair of flat portions 31*p*, parallel to the axial line of the electron gun 3, are formed on the inner tubular member 31. The flat portions 31*p* are positioned symmetrically so as to sandwich the insertion hole 31*h* in between and have shapes that bulge toward the anode tip 5*a* side from an inner wall surface 31*j*. The flat portions 31*p* function as electrodes for putting the electric field, via which the electrons emitted from the electron gun 3 reach the target 5*d*, into a desired state.

In the X-ray tube 2A, by the provision of the above-described inner tubular member 31, disruption of the electric field across the anode tip 5*a* and the edge of the exhaust port 17 is alleviated. Thus, discharge across the anode tip 5*a* and the edge of the exhaust port 17 is suppressed. As a result, in the X-ray tube 2A, destabilization of the X-ray output due to discharge is suppressed and stable X-ray irradiation is enabled. Also, by the gaps S1 and S2, the interior of the exhaust tube 21 and the internal space R are put in communication, and because the gaps S1 and S2 function as passages for air, vacuum drawing of the internal space R via the exhaust port 17 can be performed without any problem during manufacture of the X-ray tube 2A.

Also, rear sides of the flat portions 31*p* are processed to shapes that are recessed from the outer wall surface 31*a*. Thus a comparatively wide space, corresponding to the amount of recess from the outer wall surface 31*a*, is formed between the inner wall surface 19 of the head 13 and the rear side of each flat portion 31*p*. Because the exhaust port 17 is positioned in the comparatively wide space between the inner wall surface 19 and the rear side of one of the flat portions 31*p* so as to face the rear side of the flat portion 31*p*, the passage of air is made good by the space and vacuum drawing of the internal space R via the exhaust port 17 during manufacture of the X-ray tube 2A is thereby facilitated.

In assembling the inner tubular member 31 onto the head 13, positioning in a direction of extension of the anode 5 is enabled by contacting of the tip 31*e* of the loopback portion with the lower end surface 13*c* of the head 13. The positioning in a surface orthogonal to the direction of extension of the anode 5 is performed by making the outer wall surface 31*a* of the inner tubular member 31 contact the inner wall surface 20 of the head 13. By such positioning of the inner tubular member 31 by the two surfaces of the inner wall surface 20 and the lower end surface 13*c* of the head 13, the gaps S1 and S2, which put the internal space R and the interior of the exhaust tube 21 in communication, can be formed with good precision.

The inner tubular member 31 is a separate member from the head 13, and because the inner tubular member 31 can be prepared independently, the inner wall surface 31*j* that is smooth and high in precision is obtained. That is, because in comparison to directly subjecting the head 13 to processing for hiding the exhaust port 17 from the anode tip 5*a*, it is easier to smoothen the inner wall surface 31*j* that faces the anode tip 5*a*, the discharge across the anode tip 5*a* and the inner tubular member 31 can be suppressed effectively.

Also at the bulb 9*a* of the X-ray tube 2A, a boundary between an insulating member and a conductive member is formed at the fused portion 9*c*. Discharge to the anode 5 thus occurs comparatively readily. However, the above-described inner tubular member 31 extends to the bulb 9*a* side and the fused portion 9*c* of the bulb 9*a* and the connecting portion 9*b* is hidden from the anode 5 by the inner tubular member 31. By this structure, disruption of an electric field across the fused portion 9*c* and the anode 5 is suppressed, and discharge across the fused portion 9*c* and the anode 5 is suppressed effectively.

Because, in the X-ray tube 2A having the shielding structure of the second mode, the discharge at the anode 5 can be suppressed effectively, destabilization of the X-ray output due to the discharge is suppressed (stable X-ray irradiation can be performed).

(First Modification Example of the X-ray Tube According to the Second Embodiment)

Figure 15:
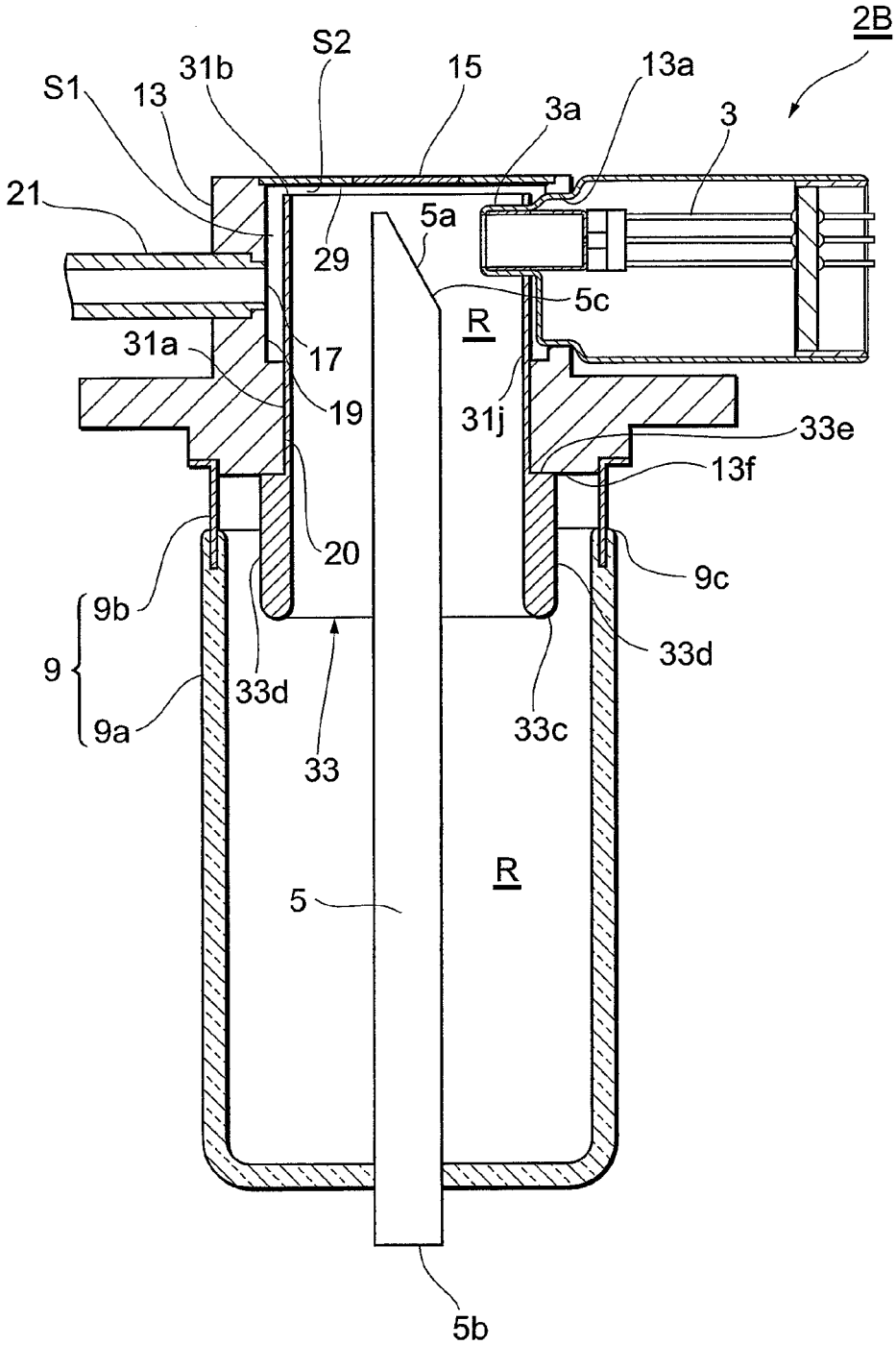
FIG. 15 is a sectional view of an arrangement of a first modification example of the X-ray tube according to the second embodiment.

Subsequently, a first modification example of the X-ray tube according to the second embodiment shall now be described with reference to FIG. 15. FIG. 15 is a sectional view of an arrangement of the first modification example of the X-ray tube according to the second embodiment.

As shown in FIG. 15, the X-ray tube 2B (first modification example of the X-ray tube according to the second embodiment) has an inner tubular member 33 in place of the inner tubular member 31 of the X-ray tube 2A. In the inner tubular member 33, a part that protrudes below the lower end surface 13*c* of the head 13 extends below the fused portion 9*c* of the bulb 9*a* and the connecting portion 9*b* and is formed to be thicker than the other portions. By such a thick portion 33*d*, the fused portion 9*c* is hidden from view from the anode 5. Furthermore, a lower end 33*c* of the thick portion 33*d* is rounded into a round shape to suppress discharge to the anode 5.

In assembling the inner tubular member 33 onto the head 13, positioning in the direction of extension of the anode 5 is performed by contacting of a step 33*e* of the thick portion 33*d* with a lower end surface 13*f* of the head 13. By such positioning of the inner tubular member 31 by the two surfaces of the inner wall surface 20 and the lower end surface 13*f* of the head 13, the gaps S1 and S2, which put the internal space R and the interior of the exhaust tube 21 in communication, can be formed with good precision with the inner tubular member 33 as well. In the X-ray tube 2B, the exhaust tube 21 is disposed at a position at which it opposes the electron gun 3.

The same actions and effects as those of the X-ray tube 2A can be exhibited by the above-described X-ray tube 2B as well.

(Second Modification Example of the X-ray Tube According to the Second Embodiment)

Figure 16:
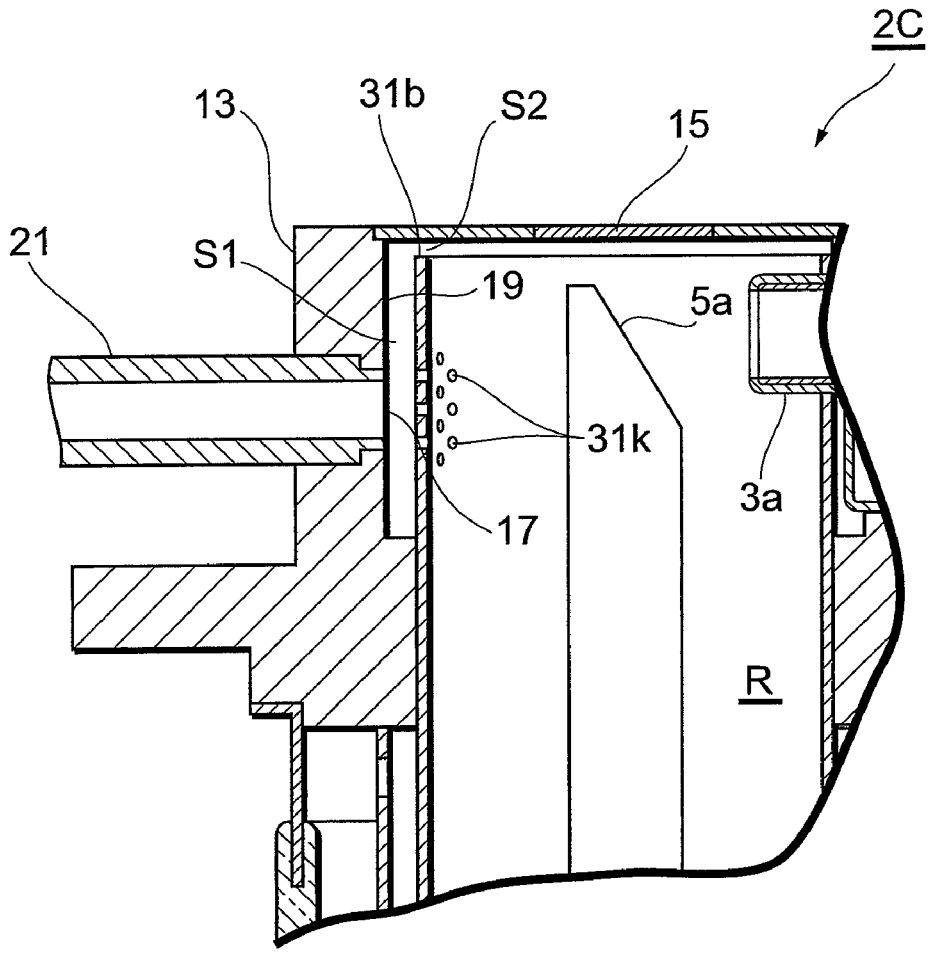
FIG. 16 is a sectional view of principal portions of a second modification example of the X-ray tube according to the second embodiment, that is, a modification example of the X-ray tube shown in FIG. 15 (first modification example of the X-ray tube according to the second embodiment)

On the other hand, FIG. 16 is a sectional view of principal portions of a second modification example of the X-ray tube according to the second embodiment, that is, a modification example of the X-ray tube 2B shown in FIG. 15. As shown in FIG. 16, in the X-ray tube 2C (second modification example of the X-ray tube according to the second embodiment), a plurality of through holes 31*k*, each of a diameter smaller than that of the exhaust port 17, may be formed at a position of the inner tubular member 31 in front of the exhaust port 17. Or, at a position in front of the exhaust port 17, a mesh-like member, having a plurality of through holes, position in front of the exhaust port 17, a mesh-like member, having a plurality of through holes, may be fitted onto the inner tubular member 31. Because with such a structure, not only the gaps S1 and S2 but the through holes 31*k* also serve as passages for air, vacuum drawing can be performed efficiently in performing vacuum drawing of the internal space R.

(Third Modification Example of the X-ray Tube According to the Second Embodiment)

Figure 17:
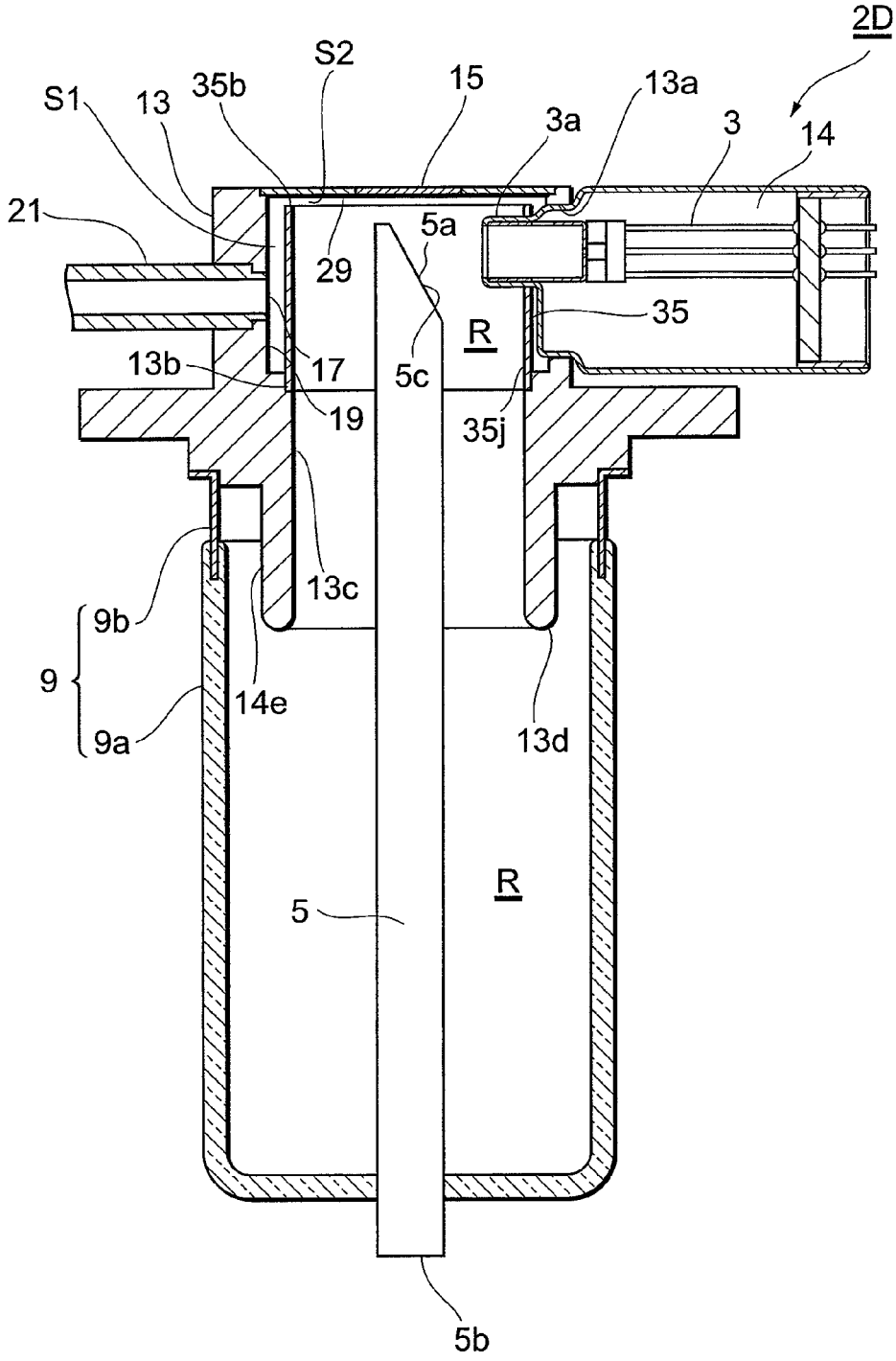
FIG. 17 is a sectional view of an arrangement of a third modification example of the X-ray tube according to the second embodiment.

Subsequently, a third modification example of the X-ray tube according to the second embodiment shall now be described with reference to FIG. 17. FIG. 17 is a sectional view of an arrangement of the third modification example of the X-ray tube according to the second embodiment.

As shown in FIG. 17, the X-ray tube 2D (third modification example of the X-ray tube according to the second embodiment) has an inner tubular member 35 in place of the inner tubular member 31 of the X-ray tube 2A. The inner tubular member 35 has a cylindrical shape with a diameter slightly less than the inner diameter of the head 13 at the inner wall surface 19 and is positioned between the inner wall surface 19 of the head 13 and the anode tip 5*a* so as to surround the anode tip 5*a*. The inner tubular member 35 is positioned by a step 13*b*, formed below the inner wall surface 19 of the head 13. By the provision of the inner tubular member 35, the exhaust port 17 is hidden from the anode tip 5*a*, and the edge of the exhaust port 17 cannot be viewed from the anode tip 5*a*.

An inner wall surface 35*j* of the inner tubular member 35 is formed so as to be matched with the inner wall surface 13*c* of the head 13. A corner portion thus does not appear at a boundary between the inner wall surface 35*j* of the inner tubular member 35 and the inner wall surface 13*c* of the head 13, and discharge across the anode 5 and either of the inner wall surface 35*j* and the inner wall surface 13*c* is suppressed.

Also, the head 13 has an annular wall portion 13*e* that extends below the fused portion 9*c* of the bulb 9*a* and the connecting portion 9*b* inside the internal space R. By the annular wall portion 13*e*, the fused portion 9*c* is hidden from view from the anode 5. Furthermore, a lower end 13*d* of the annular head 13 is rounded into a round shape to suppress discharge to the anode 5.

The same actions and effects as those of the X-ray tube 2A can be exhibited by the above-described X-ray tube 2D as well.

The present invention is not restricted to the above-described second embodiment and modification examples thereof and can be modified variously. For example, although the inner tubular member 31 is provided with the flat portions 31*p*, the flat portions 31*p* may be omitted. Also, although the bulb 9*a* and the head 13 are joined via the connecting portion 9*b*, the bulb 9*a* and the head 13 may be joined together directly. Also, although the target 5*d* is disposed as a separate member on the inclined surface 5*c* of the anode 5, the anode 5 and the target 5*d* can be made integral so that a part of the inclined surface 5*c* constitutes the target. Also, although the anode 5 has a shape having the inclined surface 5*c* disposed at the tip of a cylindrical column, other shapes can be provided at the tip of the anode 5 by any of various types of carving. In this case, even when a corner-like portion is present at the tip of the anode, discharge across the anode tip and the exhaust port can be suppressed effectively by the inner tubular member 31.

Figure 18:
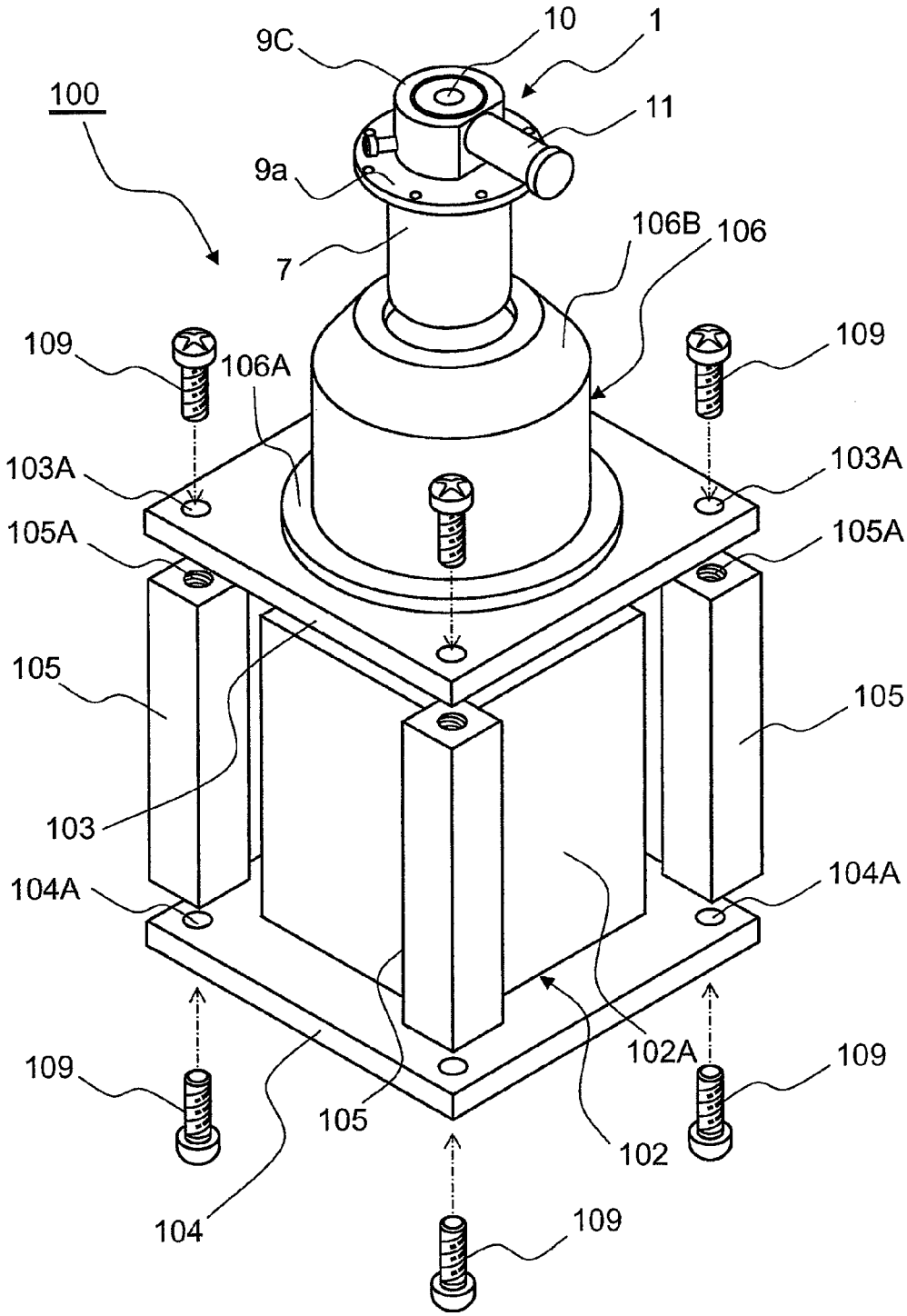
FIG. 18 is an exploded perspective view of an arrangement of an embodiment of an X-ray source according to the present invention.
Figure 19:
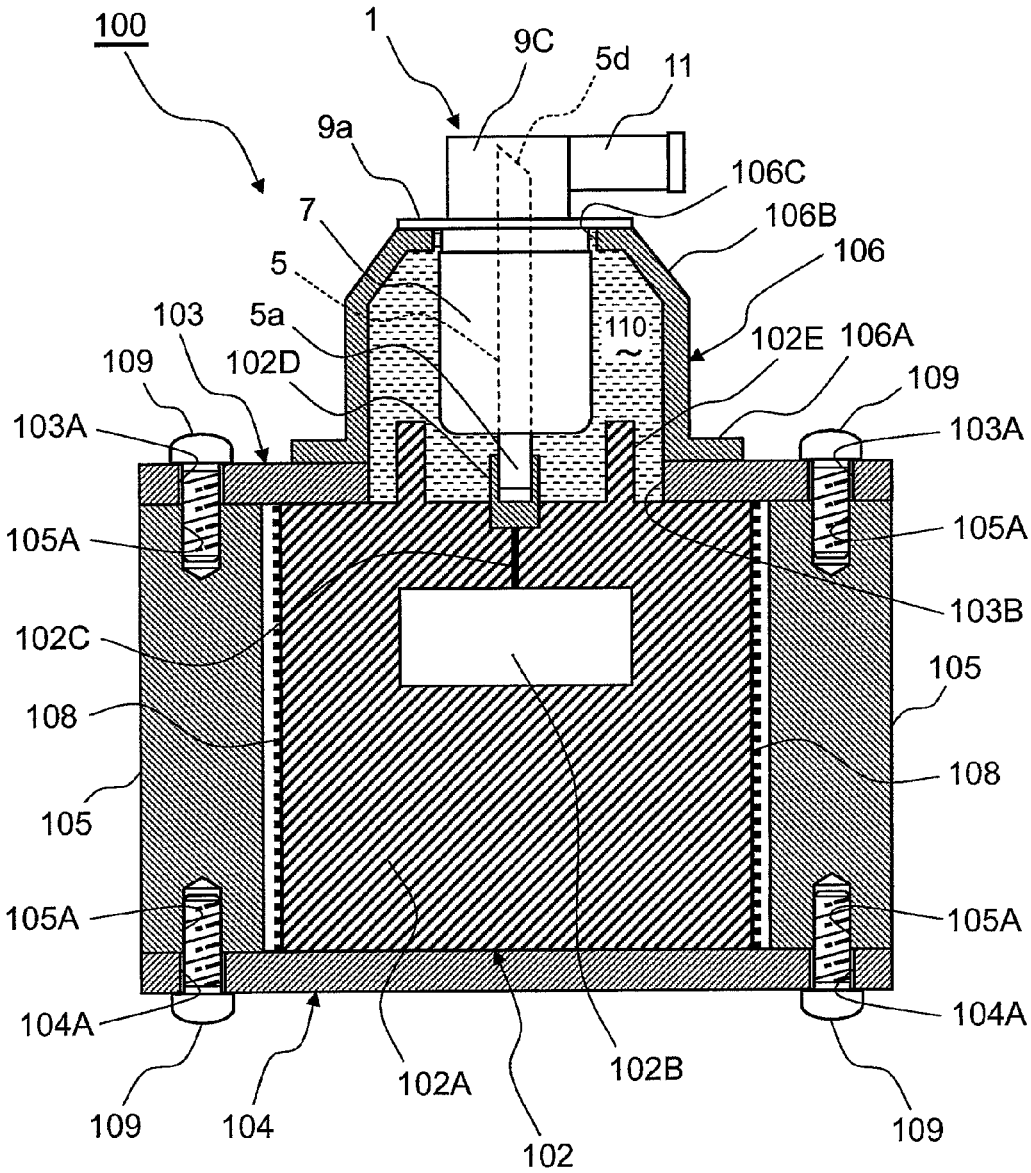
FIG. 19 is a sectional view of an internal structure of the X-ray source according to the embodiment.

An X-ray source 100 according to the present invention, to which an X-ray tube with any of the above-described structures (an X-ray tube according to the present invention) is applied, shall now be described with reference to FIGS. 18 and 19. FIG. 18 is an exploded perspective view of an arrangement of an embodiment of the X-ray source according to the present invention. FIG. 19 is a sectional view of an internal structure of the X-ray source according to the embodiment. Although any of the X-ray tubes 1A to 1D according to the first embodiment and the X-ray tubes 2A to 2D according to the second embodiment can be applied to the X-ray source 100 according to the present invention, for the sake of simplicity, all X-ray tubes applicable to the X-ray source 100 shall be expressed simply as "X-ray tube 1" in the description that follows and in the relevant drawings.

As shown in FIGS. 18 and 19, the X-ray source 100 includes a power supply unit 102, a first plate member 103, disposed at an upper surface side of an insulating block 102A of the power supply unit 102, a second plate member 104, disposed at a lower surface side of the insulating block 102A, four fastening spacer members 105, interposed between the first plate member 103 and the second plate member 104, and an X-ray tube 1, fixed above the first plate member 103 via a metal tubular member 106. The power supply unit 102 has a structure, with which a high voltage generating unit 102B, a high voltage line 102C, a socket 102D, etc., (see FIG. 19), are molded inside the insulating block 102A comprised of an epoxy resin.

The insulating block 102A of the power supply unit 102 has a short, rectangular column shape, with the mutually parallel upper surface and lower surface of substantially square shapes. At a central portion of the upper surface is disposed the cylindrical socket 102D, connected to the high voltage generating unit 102B via the high voltage line 102C. An annular wall portion 102E, positioned concentric to the socket 102D, is also disposed on the upper surface of the insulating block 102A. A conductive coating 108 is applied to peripheral surfaces of the insulating block 102A to make a potential thereof the GND potential (ground potential). A conductive tape may be adhered in place of coating the conductive coating.

The first plate member 103 and the second plate member 104 are members that, for example, act together with the four fastening spacer members 105 and eight fastening screws 109 to clamp the insulating block 102A of the power supply unit 102 in the vertical direction in the figure. The first plate member 103 and the second plate member 104 are formed to substantially square shapes that are larger than the upper surface and the lower surface of the insulating block 102A. Screw insertion holes 103A and 104A, for insertion of the respective fastening screws 109, are formed respectively at four corners of the first plate member 103 and the second plate member 104. A circular opening 103B, surrounding the annular wall portion 102E that protrudes from the upper surface of the insulating block 102A, is formed in the first plate member 103.

The four fastening spacer members 105 are formed to rectangular column shapes and are disposed at the four corners of the first plate member 103 and the second plate member 104. Each fastening spacer member 105 has a length slightly shorter than an interval between the upper surface and the lower surface of the insulating block 102A, that is, a length shorter than the interval by just a fastening allowance of the insulating block 102A. Screw holes 105A, into each of which a fastening screw 109 is screwed, is formed at upper and lower end surfaces of each fastening spacer member 105.

The metal tubular member 106 is formed to a cylindrical shape and has a mounting flange 106A formed at a base end thereof and fixed by screws across a sealing member to a periphery of the opening 103B of the first plate member 103. A peripheral surface at a tip of the metal tubular member 106 is formed to a tapered surface 106B. By the tapered surface 106B, the metal tubular member 106 is formed to a tapered shape without any corner portions at the tip. An opening 106C, through which a bulb 7 of the X-ray tube 1 is inserted, is formed in a flat, tip surface that is continuous with the tapered surface 106B.

The X-ray tube 1 includes the bulb 7, holding and housing the anode 5 in an insulated state, an upper portion 9*c* of the head 9, housing the reflecting type target 5*d* that is made electrically continuous with and formed at an inner end portion of the anode 5, and an electron gun housing unit 11, housing the electron gun 15 that emits an electron beam toward an electron incidence surface (reflection surface) of the target 5*d*. A target housing unit is formed by the bulb 7 and the head 9.

The bulb 7 and the upper portion 9*c* of the head 9 are positioned so as to be matched in tube axis, and these tube axes are substantially orthogonal to a tube axis of the electron gun housing unit 11. A flange 9*a*, for fixing to the tip surface of the metal tubular member 106, is formed between the bulb 7 and the upper portion 9*c* of the head 9. A base end 5*a* (portion at which a high voltage is applied from the power supply unit 102) of the anode 5 protrudes downward from a central portion of the bulb 7 (see FIG. 19).

An exhaust tube is attached to the X-ray tube 1, and a sealed vacuum container is formed by interiors of the bulb 7, the upper portion 9*c* of the head 9, and the electron gun housing unit 11 being depressurized to a predetermined degree of vacuum via the exhaust tube.

In the X-ray tube 1, the base end 5*a* (high voltage application portion) is fitted into the socket 102D molded in the insulating block 102A of the power supply unit 102. High voltage is thereby supplied from the high voltage generating unit 102B and via the high voltage line 102C to the base end 5*a*. When in this state, the electron gun 15, incorporated in the electron gun housing unit 11, emits electrons toward the electron incidence surface of the target 5*d*, X-rays, generated by the incidence of the electrons from the electron gun 15 onto the target 5*d*, are emitted from an X-ray emission window 10, fitted into an opening of the upper portion 9*c* of the head 9.

Here, the X-ray source 100 is assembled, for example, by the following procedure. First, the four fastening screws 109, inserted through the respective screw insertion holes 104A of the second plate member 104, are screwed into the respective screw holes 105A at the lower end surfaces of the four fastening spacer members 105. And by the four fastening screws 109, inserted through the respective screw insertion holes 103A of the first plate member 103, being screwed into the respective screw holes 105A at the upper end surfaces of the four fastening spacer members 105, the first plate member 103 and the second plate member 104 are mutually fastened while clamping the insulating block 102A in the vertical direction. A sealing member is interposed between the first plate member 103 and the upper surface of the insulating block 102A, and likewise, a sealing member is interposed between the second plate member 104 and the lower surface of the insulating block 102A.

A high voltage insulating oil 110, which is a liquid insulating substance, is then injected into an interior of the metal tubular member 106 from the opening 106C of the metal tubular member 106 that is fixed above the first plate member 103. The bulb 7 of the X-ray tube 1 is then inserted from the opening 106C of the metal tubular member 106 into the interior of the metal tubular member 106 and immersed in the high voltage insulating oil 110. In this process, the base end 5*a* (high voltage application portion) that protrudes downward from the central portion of the bulb 7 is fitted into the socket 102D at the power supply unit 102 side. The flange 9*a* of the X-ray tube 1 is then fixed by screwing across the sealing member onto the tip surface of the metal tubular member 106.

In the X-ray source 100, assembled by the above process, the annular wall portion 102E, protruded from the upper surface of the insulating block 102A of the power supply unit 102, and the metal tubular member 106 are positioned concentric to the anode 5 of the X-ray tube 1 as shown in FIG. 19. Also, the annular wall portion 102E protrudes to a height of surrounding and shielding the periphery of the base end 5*a* (high voltage application portion), which protrudes from the bulb 7 of the X-ray tube 1, from the metal tubular member 106.

In the X-ray source 100, when a high voltage is applied to the base end 5*a* of the X-ray tube 1 from the high voltage generating unit 102B of the power supply unit 102 and via the high voltage line 102C and the socket 102D, the high voltage is supplied to the target 5*d* via the anode 5. When in this state, the electron gun 15, housed in the electron gun housing unit 11, emits electrons toward the electron incidence surface of the target 5*d*, housed in the upper portion 9*c* of the head 9, the electrons become incident on the target 5*d*. The X-rays that are thereby generated at the target 5*d* are emitted to the exterior via the X-ray emission window 10, fitted onto the opening of the upper portion 9*c* of the head 9.

Here, in the X-ray source 100, the metal tubular member 106, housing the bulb 7 of the X-ray tube 1 in a state of being immersed in the high voltage insulating oil 110, is protruded from and fixed above the exterior of the insulating block 102A of the power supply unit 2, that is, the first plate member 103. A good heat dissipating property is thus realized, and heat dissipation of the high voltage insulating oil 110 inside the metal tubular member 106 and the bulb 7 of the X-ray tube 1 can be promoted.

The metal tubular member 106 has a cylindrical shape with the anode 5 disposed at the center. In this case, because the distance from the anode 5 to the metal tubular member 106 is made uniform, an electric field formed in a periphery of the anode 5 and the target 5*d* can be stabilized. The metal tubular member 106 can thus effectively discharge charges of the charged high voltage insulating oil 110.

Furthermore, the annular wall portion 102E, protruded on the upper surface of the insulating block 102A of the power supply unit 102, surrounds the periphery of the base end 5*a* (high voltage application portion), protruding from the bulb 7 of the X-ray tube 1, and thereby shields the base end 5*a* from the metal tubular member 106. Abnormal discharge from the base end 5*a* to the metal tubular member 106 is thus prevented effectively.

The X-ray source 100 has the structure with which the insulating block 102A of the power supply unit 102 is clamped between the first plate member 103 and the second plate member 104 that are fastened to each other via the four fastening spacer members 105. This means that conductive foreign objects that can induce discharge and charged foreign objects that can induce disruption of electric field are not present inside the insulating block 102A. Thus, in the X-ray source 100 according to the present invention, unwanted discharge phenomena and electric field disruptions in the power supply unit 102 are suppressed effectively.

Figure 20:
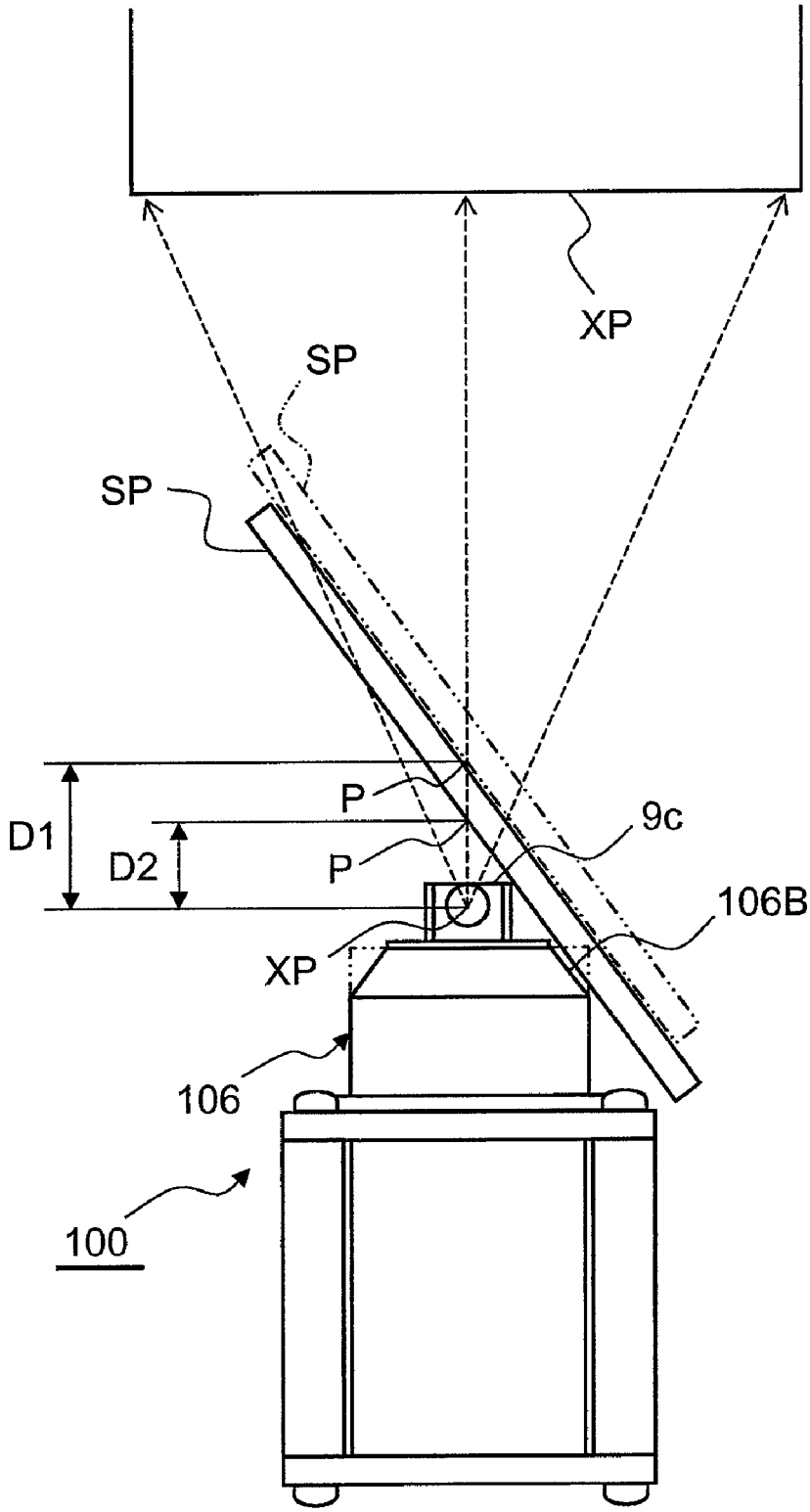
FIG. 20 is a front view for describing actions of the X-ray source (including the X-ray tube according to the embodiment) incorporated in an X-ray generating apparatus of a nondestructive inspection apparatus.

Here, the X-ray source 100 is incorporated and used, for example, in an X-ray generating apparatus that irradiates X-rays onto a sample in a nondestructive inspection apparatus, with which an internal structure of the sample is observed in the form of a transmission image. FIG. 20 is a front view for describing actions of an X-ray source (including the X-ray tube according to the embodiment) that is incorporated, as a usage example of the X-ray source 100, in an X-ray generating apparatus of a nondestructive inspection apparatus.

The X-ray source 100 irradiates X-rays to a sample plate SP, positioned between an X-ray camera XC and the X-ray source 100. That is, the X-ray source 100 irradiates X-rays onto the sample plate SP through the X-ray emission window 10 from an X-ray generation point XP of the target 5*d*, incorporated in the upper portion 9*c* of the head 9 that protrudes above the metal tubular member 106.

In such a usage example, because the shorter the distance from the X-ray generation point XP to the sample plate SP, the greater the magnification factor of the transmission image of the sample plate SP taken by the X-ray camera XC, the sample plate SP is normally positioned close to the X-ray generation point XP. Also, to observe the internal structure of the sample plate SP three-dimensionally, the sample plate SP is inclined around an axis orthogonal to a direction of irradiation of the X-rays.

If, when an observation point P of the sample plate SP is to be observed three-dimensionally upon being brought close to the X-ray generation point XP while inclining the in FIG. 20, corner portions, such as indicated by alternate long and two short dashes lines, are left at a tip of the metal tubular member 106 of the X-ray source 100, the observation point P of the sample plate SP can be made to approach the X-ray generation point XP only up to a distance, with which the sample plate SP contacts a tip corner portion of the metal tubular member 106 that is, only up to a distance at which a distance from the X-ray generating point XP to the observation point P becomes D1.

On the other hand, in the X-ray source 100, with which the tip of the metal tubular member 106 is configured to have a tapered shape without a corner portion by the provision of the tapered surface 106B as shown in FIGS. 18 and 19, the observation point P of the sample plate SP can be made to approach the X-ray generation point XP to a distance, with which the sample plate SP contacts the tapered surface 106B of the metal tubular member 106 as indicated by solid lines FIG. 20, that is, to a distance at which the distance from the X-ray generating point XP to the observation point P becomes D2. Consequently, the transmission image of the observation point P of the sample plate SP can be magnified further and nondestructive inspection of the observation point P can be performed more precisely.

The X-ray source 100 according to the present invention is not restricted to the above-described embodiment. For example, although a cross-sectional shape of an inner peripheral surface of the metal tubular member 106 is preferably circular, a cross-sectional shape of an outer peripheral surface of the metal tubular member 106 is not restricted to being circular and may be a rectangular shape or other polygonal shape. In this case, the peripheral surface of the tip of the metal tubular member can be formed to be an inclined surface.

The insulating block 102A of the power supply unit 102 may have a short, cylindrical shape, and the first plate member 103 and the second plate member 104 may correspondingly have disk shapes. The fastening spacer members 105 may have cylindrical shapes and the number thereof is not restricted to four.

The structure of the X-ray tube 1 may be a structure with which the electron gun is disposed inside the bulb 7.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

INDUSTRIAL APPLICABILITY

The X-ray tube according to the present invention can be applied as an X-ray generating source in various X-ray imaging apparatuses that are frequently used for nondestructive, noncontact observations.

The invention claimed is:

1. An X-ray tube for taking out X-rays generated at an X-ray target to an exterior by making electrons emitted from an electron gun be incident on the X-ray target positioned at a tip of an anode, said X-ray tube comprising:

a casing, defining an internal space that houses the tip of said anode;

an irradiation window, provided on said casing, for taking out the X-rays generated at said X-ray target to the exterior of said casing;

an exhaust port, provided at a predetermined position of an inner wall surface of said casing that faces said anode, for vacuuming the internal space; and a shielding structure, provided in the internal space of said casing, for hiding said exhaust port from the tip of said anode.

2. An X-ray tube according to claim 1, wherein said shielding structure includes a shielding member that is comprised of a conductive material and that has an inner side surface facing the tip of said anode, and an outer side surface opposing said inner side surface.

3. An X-ray tube according to claim 2, wherein said shielding member is disposed between the tip of said anode and said exhaust port in a state of being separated by a predetermined distance from the inner wall surface of said casing, and wherein at least the inner side surface of said shielding member has an area larger than an opening area of said exhaust port.

4. An X-ray tube according to claim 2, wherein said shielding member is disposed between the tip of said anode and said exhaust port in a state of being separated by a predetermined distance from a region, within the inner wall surface of said casing, where is positioned at the irradiation window side.

5. An X-ray tube according to claim 2, wherein said shielding member has a plurality of through holes each putting the inner side surface in communication with the outer side surface.

6. An X-ray tube according to claim 2, wherein said shielding member includes a part of said casing which extends from the inner wall surface of said casing to the internal space.

7. An X-ray tube according to claim 2, wherein said shielding member has a plurality of through holes each putting the inner side surface and the outer side surface in communication, and wherein said shielding member is disposed so that the inner side surface of said shielding member, facing the tip of said anode, is matched with the inner wall surface of said casing.

8. An X-ray tube according to claim 1, wherein said casing has:

a first anode housing portion being a hollow member, comprised of a conductive material, surrounding the tip of said anode, said first anode housing portion being provided with said exhaust port and having said irradiation window at an inner wall surface thereof; and a second anode housing portion defining an internal space for housing said anode together with said first anode housing portion, by being joined to said first anode housing portion, and wherein said shielding structure includes an inner tubular member being a hollow member disposed in the internal space of said casing so as to surround at least the tip of said anode, said inner tubular member functioning to hide said exhaust port from the tip of said anode by a part thereof being positioned between the inner wall surface of said first anode housing portion and the tip of said anode while being separated by a predetermined distance from the inner wall surface of said first anode housing portion.

9. An X-ray tube according to claim 8, wherein said inner tubular member is disposed in the internal space of said casing while an end portion thereof is separated from an inner wall surface at the irradiation window side of said first anode housing portion.

10. An X-ray tube according to claim 8, wherein a part of said inner tubular member has a plurality of through holes each extending from the tip of said anode to the inner wall surface of said first anode housing portion.

11. An X-ray tube according to claim 8, wherein said first anode housing portion has a head comprised of a conductive material, wherein said second anode housing portion has a bulb comprised of an insulating material, and a connecting portion comprised of a conductive material, said connecting portion being joined to an end of said bulb and joined to said head, and wherein said inner tubular member has a shape extending toward the second anode housing portion side in the internal space so as to hide a joined portion of said bulb and said connecting portion from said anode.

12. An X-ray tube according to claim 8, wherein said second anode housing portion has a bulb comprised of an insulating material, wherein said first anode housing portion has a head comprised of a conductive material, and a connecting portion comprised of a conductive material, said connecting portion being disposed at an end of said head and joined to said bulb, and wherein said inner tubular member has a shape extending toward the second anode housing portion side in the internal space so as to hide a joined portion of said bulb and said connecting portion from said anode.

13. An X-ray tube according to claim 11, wherein said inner tubular member has a loopback portion whose end at the second anode housing portion side is looped back into a round shape, wherein a tip of said loopback portion is joined to said first anode housing portion, and wherein said loopback portion has one or more through holes.

14. An X-ray source comprising:

an X-ray tube according to claim 1; and a power supply unit supplying a voltage for generating X-rays at the X-ray target.

* * * * *